US005175691A

United States Patent [19]

Baker et al.

[11] Patent Number: 5,175,691

[45] Date of Patent: Dec. 29, 1992

[54] SYSTEM AND METHOD FOR CONTROLLING AN APPARATUS TO PRODUCE ITEMS IN SELECTED CONFIGURATIONS

[75] Inventors: Walter J. Baker, Stratford; Christopher S. Riello, Hamden, both of Conn.

[73] Assignee: Pitney Bowes Inc., Stamford, Conn.

[21] Appl. No.: 492,039

[22] Filed: Mar. 12, 1990

[51] Int. Cl.[5] ..... B65H 39/02

[52] U.S. Cl. ..... 364/478

[58] Field of Search ..... 364/478, 138, 464.62, 364/464.63

[56] References Cited

U.S. PATENT DOCUMENTS

| | | | |
|---|---|---|---|
| 3,265,382 | 7/1966 | Sherman | 270/45 |
| 3,382,778 | 5/1968 | Berkowitz | 93/61 |
| 3,457,696 | 7/1969 | Berkley | 53/31 |
| 3,510,122 | 5/1970 | Gavaghan | 270/68 |
| 3,820,447 | 6/1974 | Gendron et al. | 93/23 |
| 3,897,720 | 7/1975 | Hiersteiner | 93/61 |
| 4,014,535 | 3/1977 | Kleid et al. | 270/19 |
| 4,022,457 | 5/1977 | Marin et al. | 270/86 |
| 4,067,171 | 1/1978 | Herbert et al. | 156/384 |
| 4,101,121 | 7/1978 | Rastorguyeff | 270/68 A |
| 4,312,169 | 1/1982 | Golicz et al. | 53/206 |
| 4,527,468 | 7/1985 | Piotroski | 364/478 |
| 4,543,082 | 9/1985 | Stenner | 493/216 |
| 4,701,233 | 10/1987 | Beck et al. | 156/217 |
| 4,707,790 | 11/1987 | Gomes et al. | 364/478 |
| 4,731,048 | 3/1988 | Marrella et al. | 493/188 |
| 4,731,741 | 3/1988 | Allen | 364/518 |
| 4,733,856 | 3/1988 | Gunther, Jr. | 270/1.1 |
| 4,800,506 | 1/1989 | Axelrod et al. | 364/478 |

*Primary Examiner*—Jerry Smith
*Assistant Examiner*—Patrick D. Muir
*Attorney, Agent, or Firm*—Robert H. Whisker; Melvin J. Scolnick

[57] ABSTRACT

An apparatus for producing items in selected configurations and a system and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on blank sheets and envelope forms. The data processor also controls the laser printer to print an address for the mail piece either on an envelope form or on a printed sheet in a position where it will be visible through the envelope. Thus the apparatus is controlled to process an output file stored in the data processor into a mail run having a selected configuration.

26 Claims, 21 Drawing Sheets

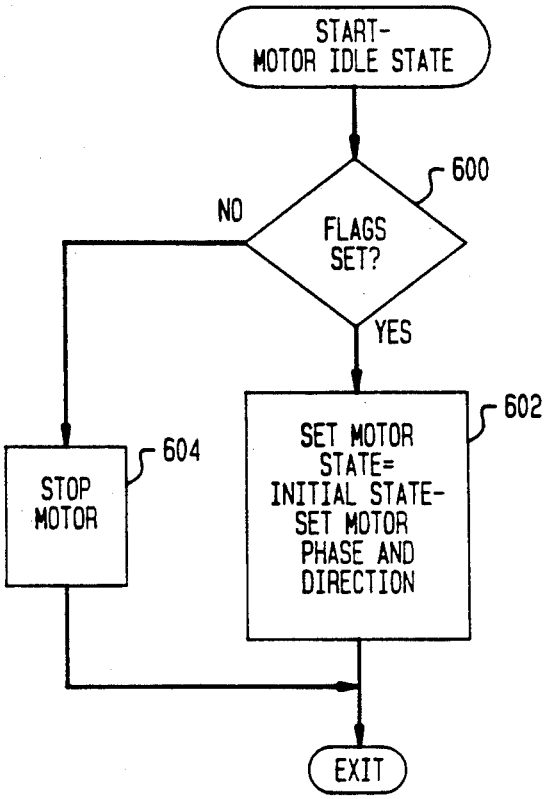
FIG. 11A
FIG. 11B
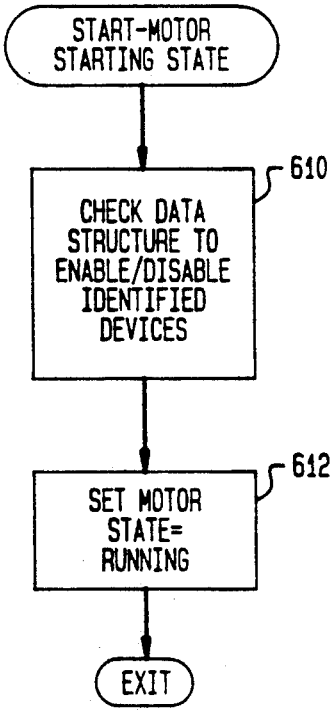

SYSTEM AND METHOD FOR CONTROLLING AN APPARATUS TO PRODUCE ITEMS IN SELECTED CONFIGURATIONS

RELATED APPLICATIONS

The subject application is one of the following group of commonly assigned patent applications, all filed on even date herewith, all of which relate to a particular development effort conducted for the assignee of the subject application and which share common elements of disclosure.

| | | |
|---|---|---|
| Ser. No. 492,043 | Envelope Form For Preparing a Multi-Sheet Mail Piece, now abandoned | (C-624) |
| Ser. No. 491,871 | System and Method for Controlling an Apparatus to Produce Mail Pieces in Non-Standard Configurations, U.S. Pat. No. 5,007,305. | (C-625) |
| Ser. No. 492,039 | System and Method for Controlling an Apparatus to Produce Mail Pieces in Selected Configurations, present application. | (C-626) |
| Ser. No. 493,016 | System and Method for Producing Items in Selected Configurations now pending. | (C-631) |
| Ser. No. 491,881 | Mechanism and Method for Accumulating and Folding Sheets, U.S. Pat. No. 5,054,757. | (C-632) |
| Ser. No. 491,875 | Flap Opening Mechanism and Method, U.S. Pat. No. 5,045,043. | (C-633) |
| Ser. No. 491,886 | Mechanism and Method for Folding Folding and Sealing the Upper and Side Flaps of an Envelope Form now abandoned. | (C-634) |
| Ser. No. 491,887 | Mechanism and Method for Laterally Aligning an Accumulation of Sheets now pending. | (C-635) |
| Ser. No. 492,035 | Sheet Feeder, now abandoned | (C-636) |

BACKGROUND OF THE INVENTION

This invention relates to apparatus for producing items in a variety of configurations. More particularly, it relates to a control system for an apparatus and process which produces mail pieces in a selected one of a plurality of possible configurations.

Self-mailers are mail pieces which are produced from pre-cut forms which are folded and sealed to form a mail piece, and are well known, as is apparatus for printing and forming such self-mailers Commonly assigned, co-pending U.S. application, Ser. No. 407,583, now abandoned, to: Samuel W. Martin, filed Sep. 14, 1989 (C-574) discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sep. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted pieces or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a window or a printed envelope, variations in the number and type of printed pages, and variations in the number and type of pre-printed inserts.) At most, like Huffman they may provide for an ability to insert "stuffers". Further, with the exception of the above mentioned U.S. application, Ser. No. 407,583 (C-574) the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe accumulated with the control document and at the last station the entire accumulation is inserted in a pre-formed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Branecky et al.; for: Process and Apparatus for Controlling Document Feeding Machines From Indicia Contained on a Document Fed Therefrom; issued: Jan. 27, 1976.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

Thus, it is an object of the subject invention to provide a system and method for controlling an apparatus and process for producing a mail piece in a selected one of a plurality of possible configurations.

It is another object of the subject invention provides such a system and method which are suitable for use with a personal computer.

BRIEF SUMMARY OF THE INVENTION

The above objects are achieved and the disadvantages of the prior art are overcome in accordance with the subject invention by means of a control system for controlling a process, which process includes operations selected from a plurality of operations, where the system includes an input of information defining a particular output configuration; translating apparatus for translating the defining information into a data structure defining a sequence of these operations to produce an item having that configuration; a control apparatus responsive to the data structure for controlling the process to perform the sequence of operations on input materials to process the input materials to produce items having that configuration.

In accordance with one aspect of the subject invention the control apparatus includes a data processor and the operations include sequences of states; and the control apparatus controls the process by executing sequences of state routines in accordance with the data structure; execution of the state routines in accordance with the data structure effecting the performance of the states.

In accordance with still another aspect, of the subject invention provides a control system for controlling an apparatus for performing a process, the apparatus including a plurality of types of devices and the control system including; an input apparatus for input of information defining an output configuration; translation apparatus for translating the defining information into a data structure; and a control apparatus including a data processor for executing state routines, each of these state routines being associated with one of the types of devices; the state routines being executed in accordance with the data structure to control operation of particular devices included in the apparatus to effect states of the particular devices; where a sequence of the states for each of these particular devices and a sequence of operation of the devices being controlled in accordance with the data structure to produce items having the output configuration.

In accordance with another aspect of the subject invention the items produced are mail pieces.

BRIEF DESCRIPTIONS OF THE DRAWINGS

FIGS. 11A through 11E show flow charts of State Routines for motors shown in FIG. 6.

DETAILED DESCRIPTION OF PREFERRED EMBODIMENTS OF THE SUBJECT INVENTION

Figure 1:
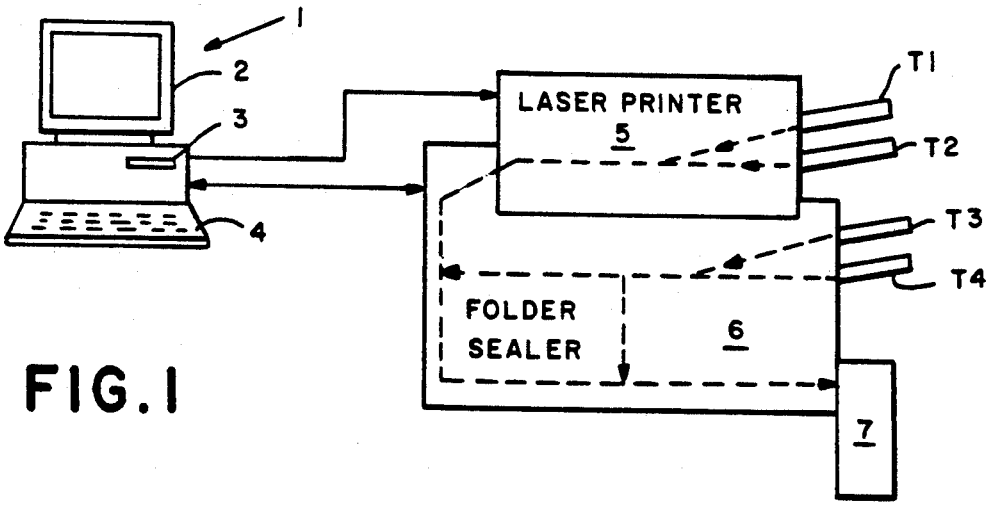
FIG. 1 shows a schematic block diagram of apparatus in accordance with the subject invention.

FIG. 1 shows a system for producing mail pieces and with which the control system of the subject invention may be used. The system includes a personal computer 1 including a monitor 2, a hard disk 3 with at least one megabyte of available storage, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 may be used for envelope forms, and tray T2 may be used for either three-thirds or two-thirds length sheets.

Laser printer 5 is mounted on, and physically connected to, folder sealer six so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Those skilled in the art will readily appreciate that the system shown in FIG. 1 provides an almost limitless ability to produce mail pieces having a selected configuration. In a preferred embodiment of the subject invention the allowable combinations are limited by the following rules:

1. Each feeder tray: T1, T2, T3, T4 will have homogenous stock.
2. Each mail piece will include exactly one envelope.
3. Each mail piece will include at least one non-envelope.
4. Each mail piece having a window envelope, will include at least one printed sheet.
5. For each mail piece a feeder will supply no more than two one-third sized sheets.
6. Each mail piece will include no more than one BRE.

7. Because of the practical limitations on folding ability each mail piece will include no more than a total of three two-thirds size or three three-thirds size sheets.

8. Because of the practical limitations on envelope thickness each mail piece will be no more than twelve sheets thick, where BRE's are considered to be two sheets thick.

Those skilled in the art will recognized that the above rules are basically matters of practicality and common sense and form no part of the subject invention per se. For example, a mail piece comprising a windowed envelope and no printed sheet would not have an address and should not be permitted. Practical limitations such as those on folding thickness or envelope thickness may be overcome by design changes without departing from the spirit of the subject invention.

Figure 2:
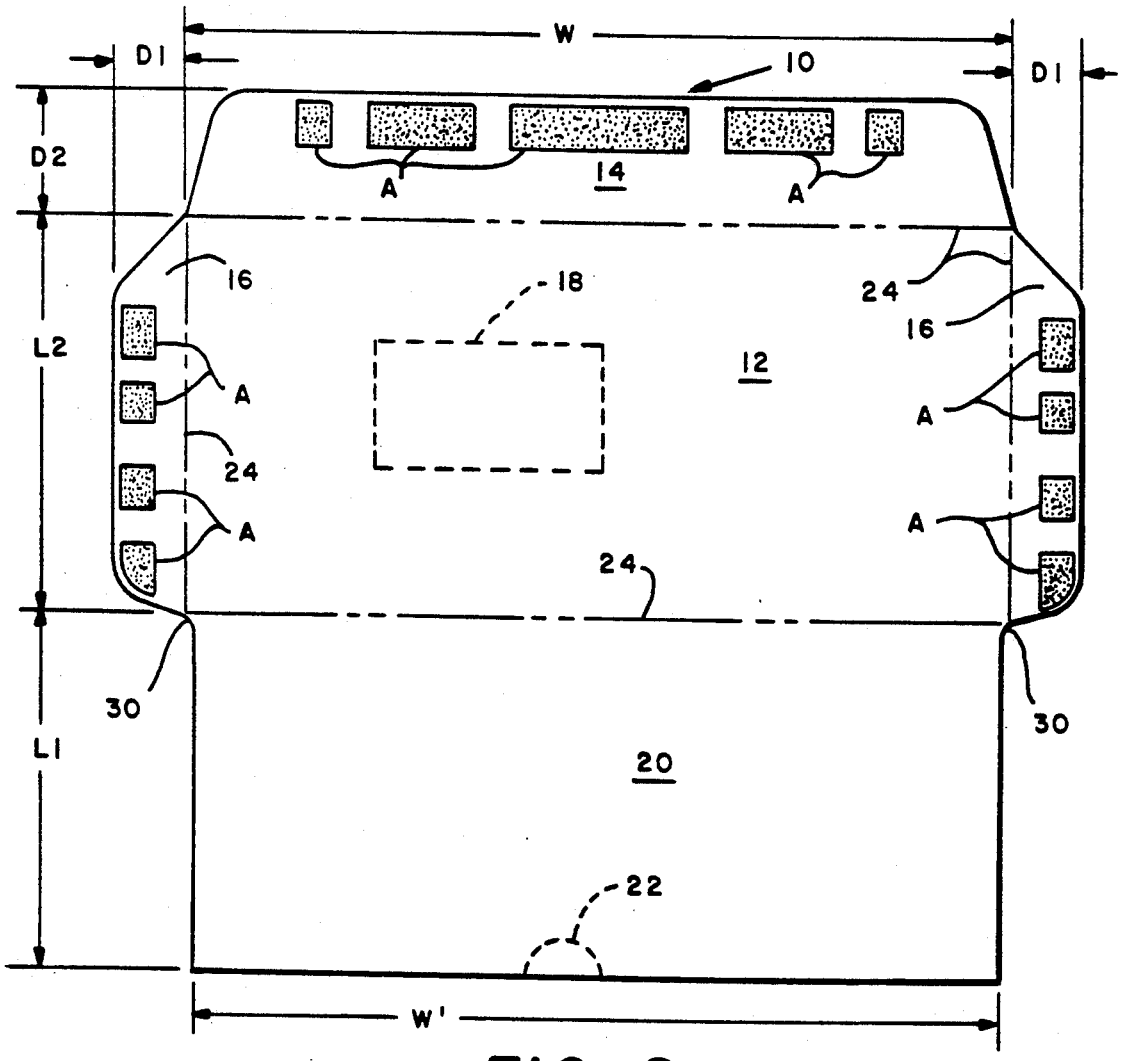
FIG. 2 shows a plan view of an envelope form suitable for use with the apparatus of FIG. 1.

FIG. 2 shows a unique envelope form, which is designed to function optimally with the apparatus of the subject invention. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A and, to prevent contamination of the rollers when adhesive A is moistened prior to sealing also, to reduce curling of the form. Adhesive A is preferably a remoistenable adhesive (such as from 0.0006 to 0.001 inches of dextrin/resin adhesive) which is moistened for sealing as will be described further below, but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines parallel to and outwards of lines 24, to allow for mail pieces having a maximum thickness and lower panel 20 may be provided with a notch 22 to facilitate removal of the sheets when the mail piece is opened.

Form 10 is designed for optimal performance with the apparatus of the subject invention. The width W of upper panel 12 is chosen to be slightly greater than the width of the sheets to be used in the mail piece and the length L1 of lower panel 20 is chosen to be approximately equal to one-third the length of a full size sheet to be used with the mail piece. The length L2 of panel 12 is chosen to be substantially greater than length L1 to allow increased tolerance in positioning these sheets on form 10. The width W' of lower panel 20 is less than or equal to the width of the sheets to be used in the mail piece. By providing width W' less than or equal to the width of the sheets, automatic centering guides may be used to center the sheets with respect to form 10 before it is folded as will be described further below. Further, a narrower lower panel 20 allows greater skew tolerance in folding the lower panel, and aids in enveloping the contents of thicker mail pieces by permitting side flaps 16 to wrap more gradually about the mail piece.

Because lower panel 20 is substantially shorter than upper panel 12 the width D of side flaps 16 and length D2 of upper flap 14 are chosen to be sufficient to assure that the sealed mail piece completely encloses the sheets. Upper flap 14 is also formed to be substantially rectangular to assure that the envelope is closed across its full width, and lower panel 20 is provided with bevels 30 so that it flares to the full width of upper panel 12 to assure that the lower corners of the completed mail piece are closed. It should also be noted that adhesive A on side flap 16 is applied so that it extends no further than lower panel 20 when the envelope is folded and does not come into contact with the sheets within the mail piece.

For a standard $8\frac{1}{2} \times 11$ size three-thirds sheet the following approximate dimensions have been found to be satisfactory for form 10.

Figure 3:
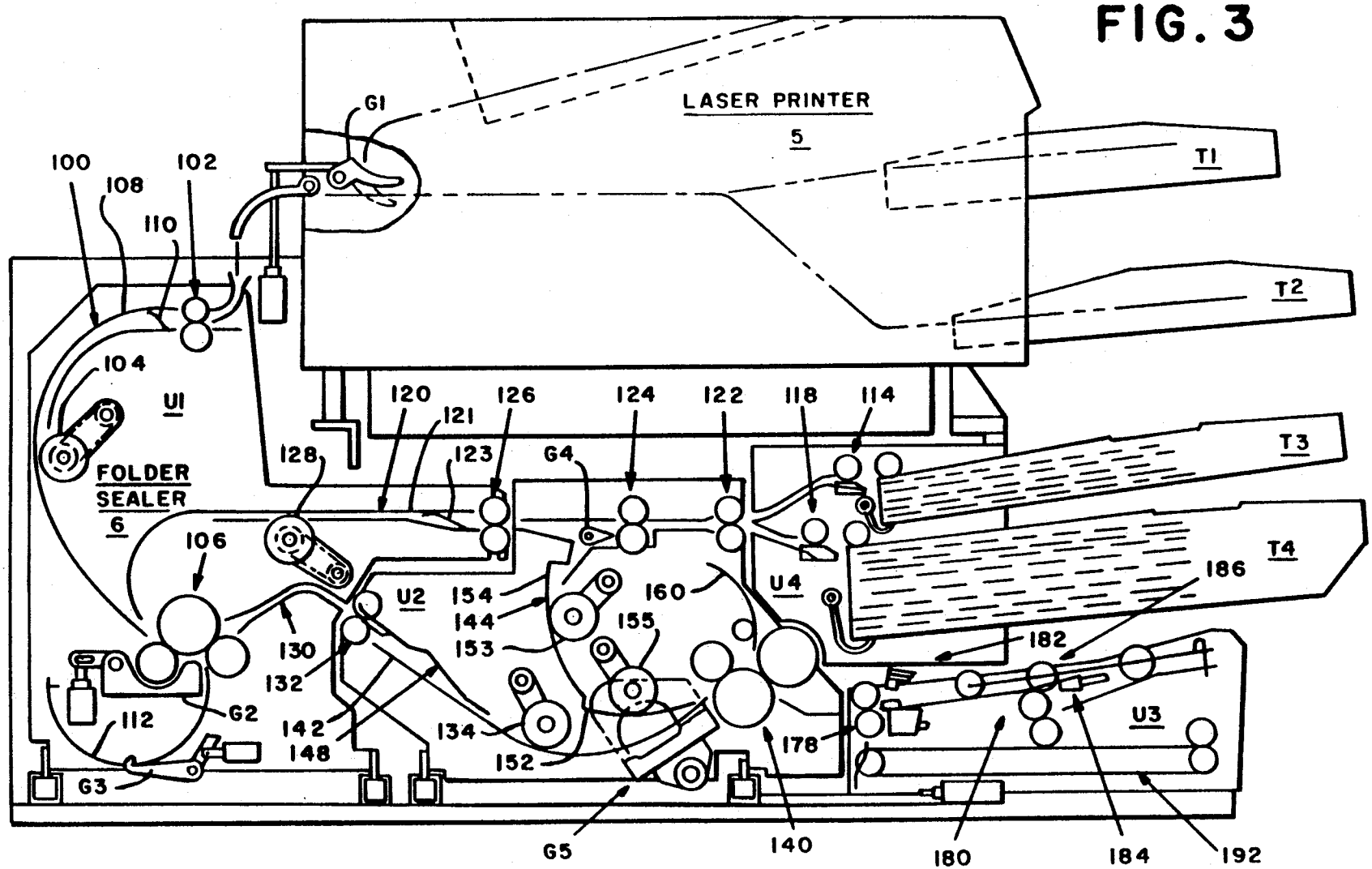
FIG. 3 shows a semi-schematic side view of a printer and a folder sealer apparatus in accordance with the subject invention.

D1 = 0.75 inches
D2 = 1.31 inches
L1 = 3.75 inches
L2 = 4.13 inches
W = 8.70 inches
W' = 8.50 inches Turning now to FIG. 3 a schematic side view of folder sealer 6 is shown. As a printed envelope form 10 or a printed sheet exit laser printer 5 it is driven along guides 100 by roller pair 102 and then urge into the nip of accumulator folder assembly 106 by urge roller 104. As used herein a sheet is "urged" when it is moved by an "urged roller" constructed to slip (or stall) on the sheet before it will buckle under the load. This contrasts with sheets which are driven by a roller pair in a positive manner, substantially without slipping.) Normally the first item will be an envelope form 10 and gate G2 will be in the activated (closed) state diverting form 10 for further processing as will be described further below. Normally following items will be printed sheets and motor M1 (shown in FIG. 6), which drives folder accumulator assembly 106, will be stopped and the sheets will be urged into the nip of assembly 106 by urge roller 104, which will continue to rotate. Because guide 1? ? is curved to increase the stiffness of the sheets roller 104 will slip on the sheet as it is urged into the nip of assembly 106 before the sheets will buckle. Relief 108 is provided in guide 100 the tail of any three-third sheets is held clear of roller pair 102 so that following printed sheets may pass over previous sheets and may be accumulated in the nip of assembly 106.

If the sheets accumulated in the nip of assembly 106 include a three-thirds sheet gate G2 is deactivated (open) and motor M1 is started and the accumulated sheets are driven into curved, open, one-sided buckle chute 112. The assembled sheets are folded by assembly 106 to a two-thirds length and exit assembly 106 for further accumulation with the previously passed form 10. Gate G3 may be activated for a "Z" fold (normally used with a window envelope); as will be described further below.

If the sheets to be printed have a significant curl it may prove necessary or desirable to use conventional closed buckle chutes or to provide some other means of controlling the folding of curled sheets predisposed to fold in the wrong direction.

Alternatively a windowed envelope or pre-printed sheets, of three-thirds length, may be fed from trays T3 or T4 by feeder assemblies 114 or 118 and, with gate G4 deactivated, driven along curved guides 120 by roller pairs 122, 124, and 126 and then urged by urge roller 128 for processing by accumulator folder assembly 106 in the same manner as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the assembled sheets, is moved along guides 130 by roller pair 132 and urge roller 134 until it is urged into the nip of accumulator folder assembly 140. Motor M2 (shown in FIG. 6), which drives assembly 140 is off and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 operates as described above so that the accumulated sheets will clear form 10 and progress to the nip of assembly 140.

Since laser printer 5 will normally have a feed path whose width is limited to conventional paper size (e.g. approximately 8½") envelope form 10, when feed through printer 5, is fed with flaps 16 folded into the closed position. Accordingly, an opening mechanism 148 is provided along path 130 to open flaps 16 before form 10 is accumulated with the following sheets.

Because form 10, with flaps 16 opened, is substantially wider than the sheets, lateral guides, G5, are provided to assure that the sheets are centered with form 10.

If two-thirds sheets, one-third sheets, or BRE's are fed from trays T3 or T4 along guides 120 gate G4 is activated and these sheets are diverted to guides 144. The diverted sheets are urged by urge rollers 146 and 148 into the nip of assembly 140 and are accumulated in the manner described above in the nip of assembly 140 with the previously processed envelope form 10, any printed sheets, and any pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140, is started and drives the completed accumulation into buckle chute 160 so that the completed accumulation is folded about fold line 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 or M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles.

Figure 4:
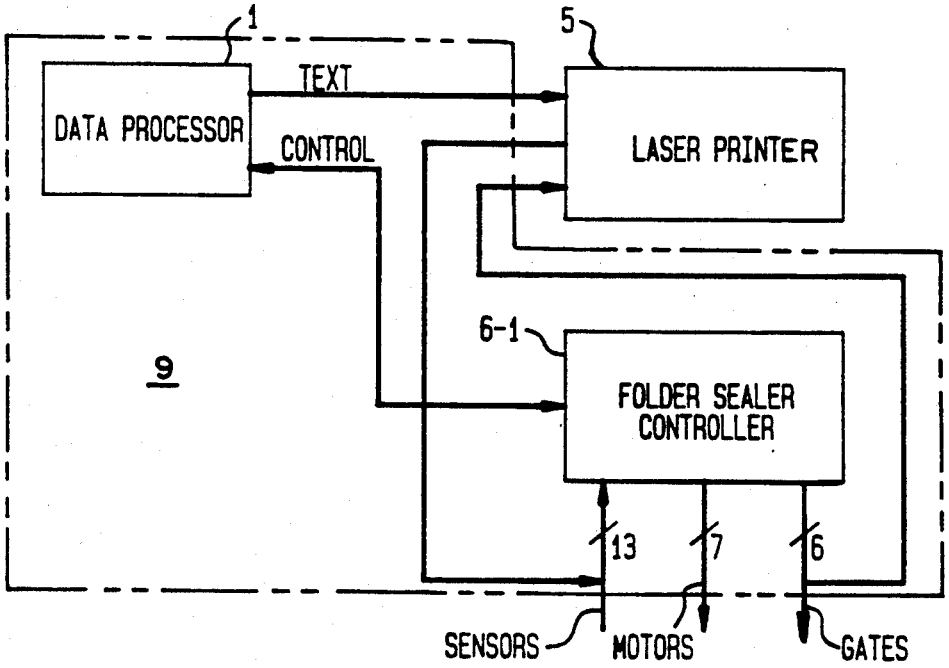
FIG. 4 shows a schematic block diagram of the flow of control and text information signals in accordance with the subject invention.
Figure 6:
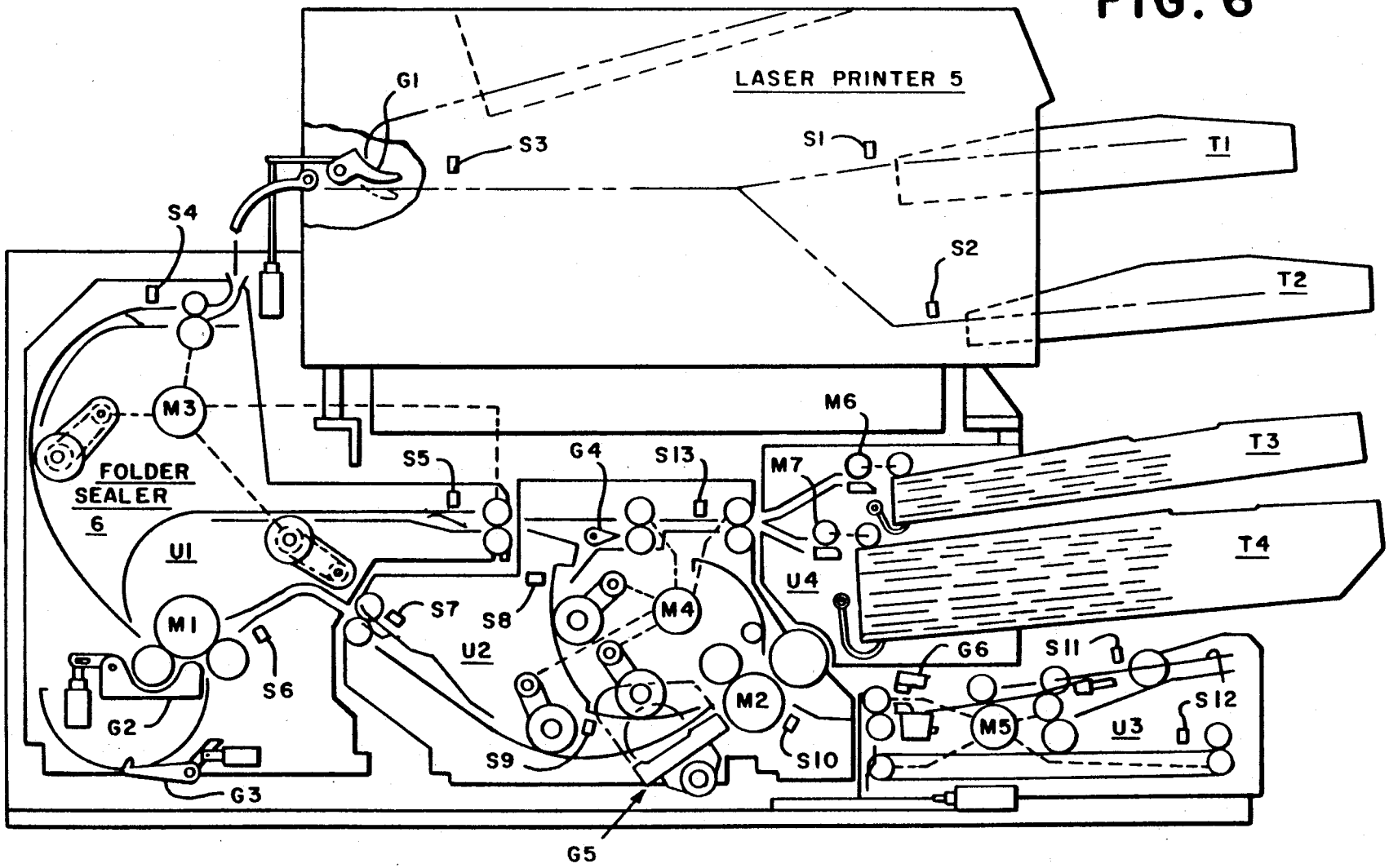
FIG. 6 shows the view of FIG. 3 showing the relationships of sensors, gates, and motors which are controlled in accordance with the subject invention to produce mail pieces having a particular configuration.

Turning to FIG. 4 the control architecture for the system of the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1, which includes an integrated circuit microcontroller, which is preferably a model 80C196KB manufactured by the Intel Corporation of California. As will be described below controller 6-1 receives data structures defining the configuration for mail pieces in a given mail run, from data processor 1, as well as specific information for each mail piece, such as ID numbers and variable numbers of printed sheets to be included in the mail piece. Controller 6-1 than controls devices, (i.e. sensors, motors, and gates) in folder sealer 6 to produce mail pieces in accordance with the data structures and specific mail piece information. As can be seen in FIG. 6, minor modifications, easily within the skill in the art have been made to laser printer 5 to allow controller 6-1 to read sensors provided in laser printer 5 and control a gate which is also part of laser printer 5. Data processor 1 and controller 6-1 together comprise a preferred embodiment of control system 9 of the subject invention.

Figure 5:
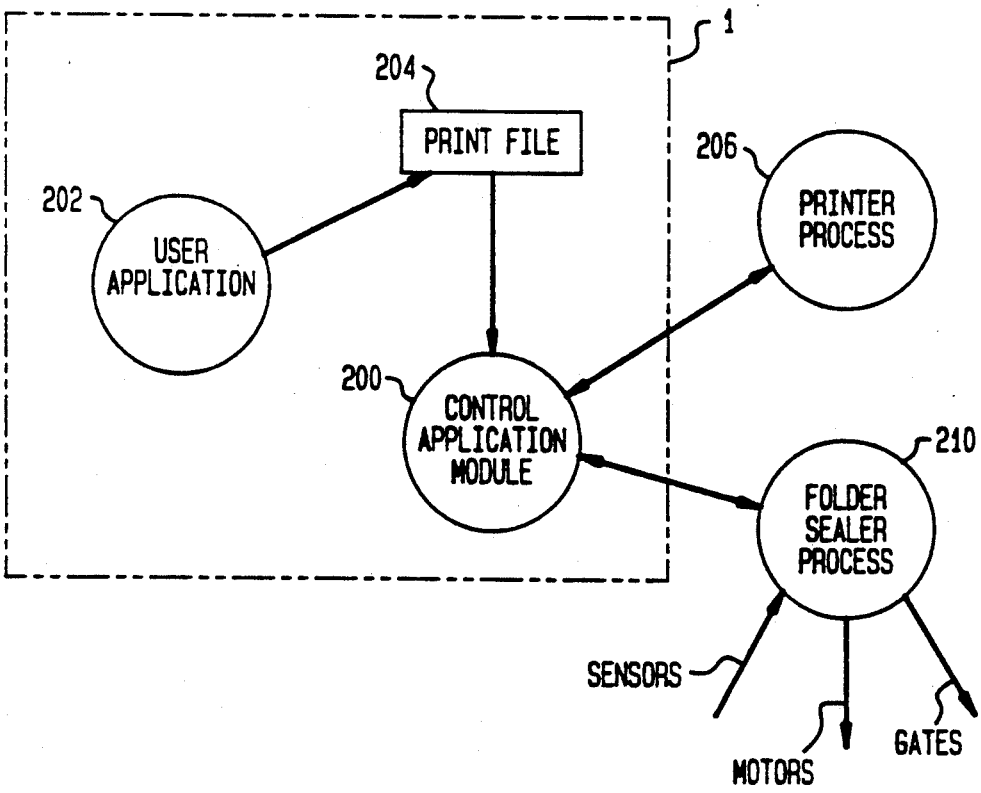
FIG. 5 shows a data flow diagram in accordance with the subject invention.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional manner, and a conventional, serial communications driver to communicate with folder sealer process 210, which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the User Application 202 and having a configuration in accordance with the data structures and specific mail piece information; as will be described further below.

FIG. 6 is a schematic diagram of the sensors, motors and gates used in the preferred embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheets after printing. Gate G1 is a mechanical gate, also part of laser printer 5, which diverts sheets for output on top of laser printer 5, and as noted, has been modified so that it operates under control of controller 6-1. Sensor S4 is an optical sensor provided in folder sealer 6 to detect passage of a printed sheet from laser printer 5 to folder sealer 6 along guides 100. Sensor S5 is an optical sensor which detects the presence of pre-printed sheets on guide 120 downstream of gate G4. Sensor S6 detects the presence of sheets output from accumulator folder assembly 106 on guides 130, and sensor S7 detects the presence of sheets accumulated in the nip of accumulator folder assembly 140. Sensors S8 and S9 detect the presence of two-thirds and one-thirds sheets, respectively, which have been diverted from guide 120 by gate G4 to accumulator folder assembly 140. Sensor S10 is an optical sensor which detects the presence of a folded envelope form 10 and accumulated sheets output from assembly 140 and sensor S11 is an optical sensor which detects the presence of form 10 and the accumulated sheets in trailing flap folder sealer 180. Sensor S12 is an optical sensor which detects the output of a folded and sealed mail piece. Sensor S13 is an optical sensor which detects the presence of pre-printed sheets on guide 120 upstream from gate G4.

Gate G1 diverts sheets after printing for output at the top of laser printer 5 so that laser printer 5 may be used as a conventional computer output line printer without printed sheets passing through folder sealer 6, and also to facilitate recovery from jam and error conditions. When activated gate G2 diverts envelope form 10 and two-thirds length printed sheets through apparatus 106 without folding. When activated gate G3 effectively shortens the length of buckle chute 112 so that sheets accumulated for folding by apparatus 106 are ultimately folded in a "Z" fold, and when deactivated allows the full length of the accumulated sheets into buckle chute 112 so that these sheets are ultimately folded in a "C" fold. Gate G4 when activated diverts pre-printed two-thirds and one-thirds length sheets and BRE's from guide 120 to guides 144 for accumulation at accumulator folder assembly 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is part of moistener 182 which moistens adhesive A on flap 14 form 10 as it enters trailing flap folder sealer 180. Gates G1-G6 are each operated individually under direct control of controller 6-1.

Motors M1 and M2 operate accumulator folder apparatuses 106 and 140 respectively. Motor M3 operates urge rollers 104 and 128, and roller pairs 102 and 126, and motor M4 operates urge rollers 153 and 155 and roller pairs 122, 124, and 132 (all shown in FIG. 3).

Motor M5 operates flap folder sealer 180 and motors M6 and M7 feed pre-printed sheets from trays T3 and T4, respectively. Motors M1 through M7 are each operated individually under the direct control of controller 6 1.

Figure 7:
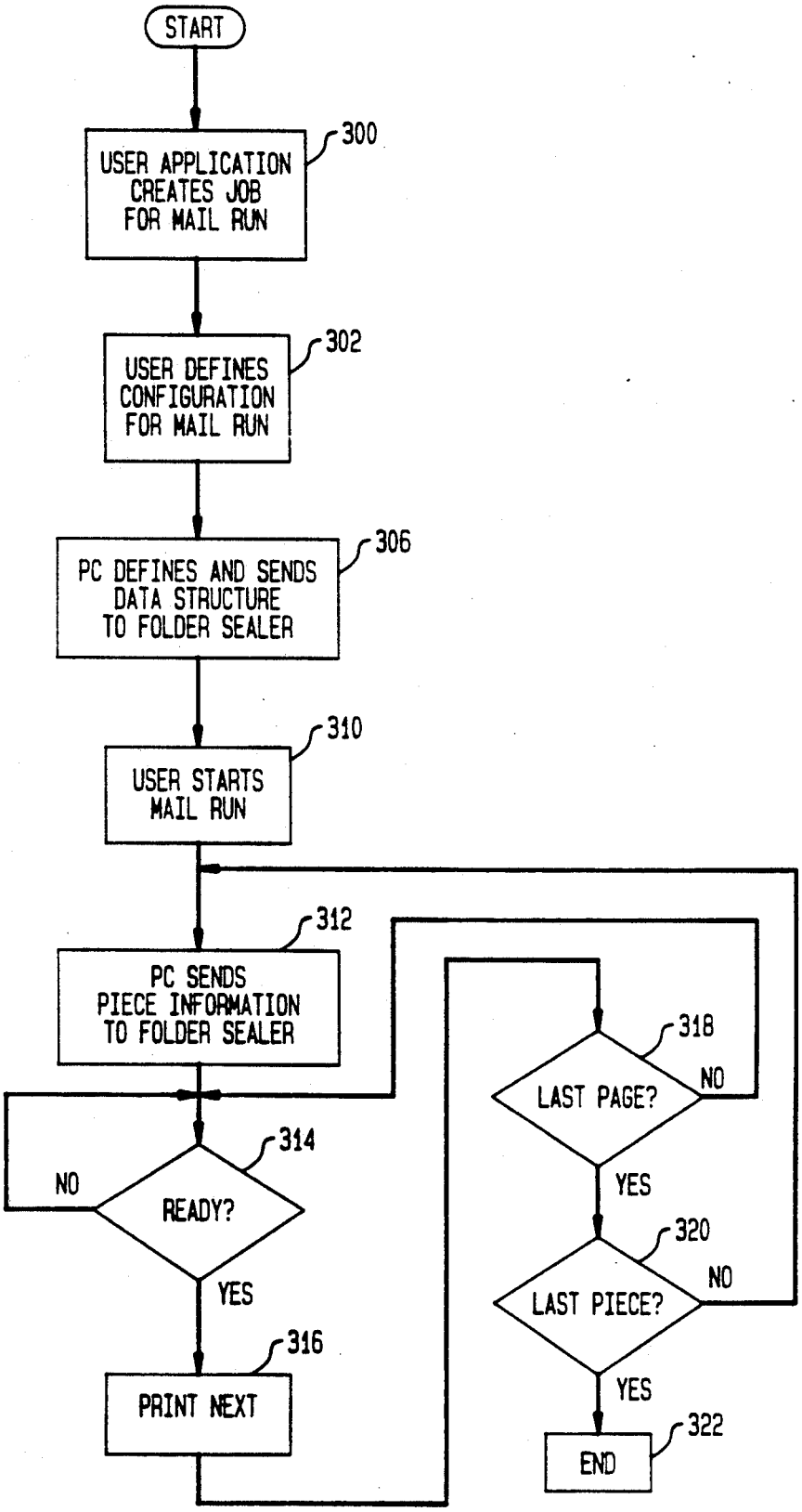
FIG. 7 shows a flow chart of the operation of the data processor of FIG. 1 in producing a mail run in accordance with the subject invention.

FIG. 7 shows a flow chart of the operation of the system of FIG. 1 in preparing a mail run. At 300 a user application, which may be any existing program which creates documents which are to be mailed, and outputs a JOB (i.e. a file of documents) to print file 204 in a conventional manner. Thus, in can be seen that the system of the subject invention interfaces with existing user application programs with minimal, if any, modification to those programs.

At 302 the Control Application Program in the Control Application Module interacts with a user who defines a configuration for the mail run by specifying the types of sheets in each of trays T1 through T4 and the number of sheets to be included from each tray in the mail piece, subject to the rules for allowable mail piece configurations specified above. Note that within these rules the number of printed pages to be included in a mail piece may vary from mail piece to mail piece within a given mail run. At this point the user may also identify an address block in the documents comprising the JOB and the Control Application Module will cause that address to be printed on a printed envelope form 10 and in selected address fields of printed sheets. Note that the control Applications Program checks to assure that occurrences of a particular address are contiguous. That is, a sheet or form 10 having a particular address may be followed by sheets having no address but a second address must not occur between two occurrences of the same address.

As will be described further below, at 306 the Control Application Program defines a data structure from the information supplied by the user defining the desired configuration for the mail run and sends this data structure to folder sealer controller 6-1. As will also be described further below controller 6-1 controls the sensors, motors, and gates described above in accordance with this data structure to produce mail pieces in the desired configuration.

Once the configuration is defined, at 310 the user may initiate a mail run. At 312 the Control Application Program sends specific piece information to folder sealer controller 6-1. Preferably, this information includes date, piece ID, which is used in recovery from jam conditions so that if part of a mail piece is lost because of a paper jam the mail piece may be reprinted without loss of data, the number of pages to be printed, which may be variable within the limitations described above, and the type and ID of the device which initiates processing for each mail piece. If the specified configuration includes a printed envelope form 10 the folder sealer operation will begin when sensor S1 senses printed envelope form 10 being fed into laser printer 5. If the configuration specifies window envelope form 10 controller 6-1 will initiate operation by activating motor M6 to feed form 10 from tray T3. At 314 and 316 the Control Application Program will activate printer 5 when folder sealer 6 is ready. If the first sheet is a printed envelope form 10 folder sealer 6 will be ready as soon as it is initialized and has responded to the piece information sent at 312 and the mail run will be initiated by the Control Application Program initiating printing of form 10 by laser printer 5; triggering sensor S1. If a window envelope form 10 is to be processed first controller 6-1 will initiate processing by activating motor M6 and the Control Application Program will respond to signals from controller 6-1 to initiate printing of sheets as required in accordance with the specified configuration. At 318 Control Application Program determines if the last printed sheet has been printed and if not returns to 314 to print the next sheet. If the last sheet has been printed at 320 the Control Application Program determines if this is the last mail piece and if not returns to 312 to begin printing of the next mail piece. When the last mail piece in a mail run has been processed the Control Application Program ends.

Figure 8A:
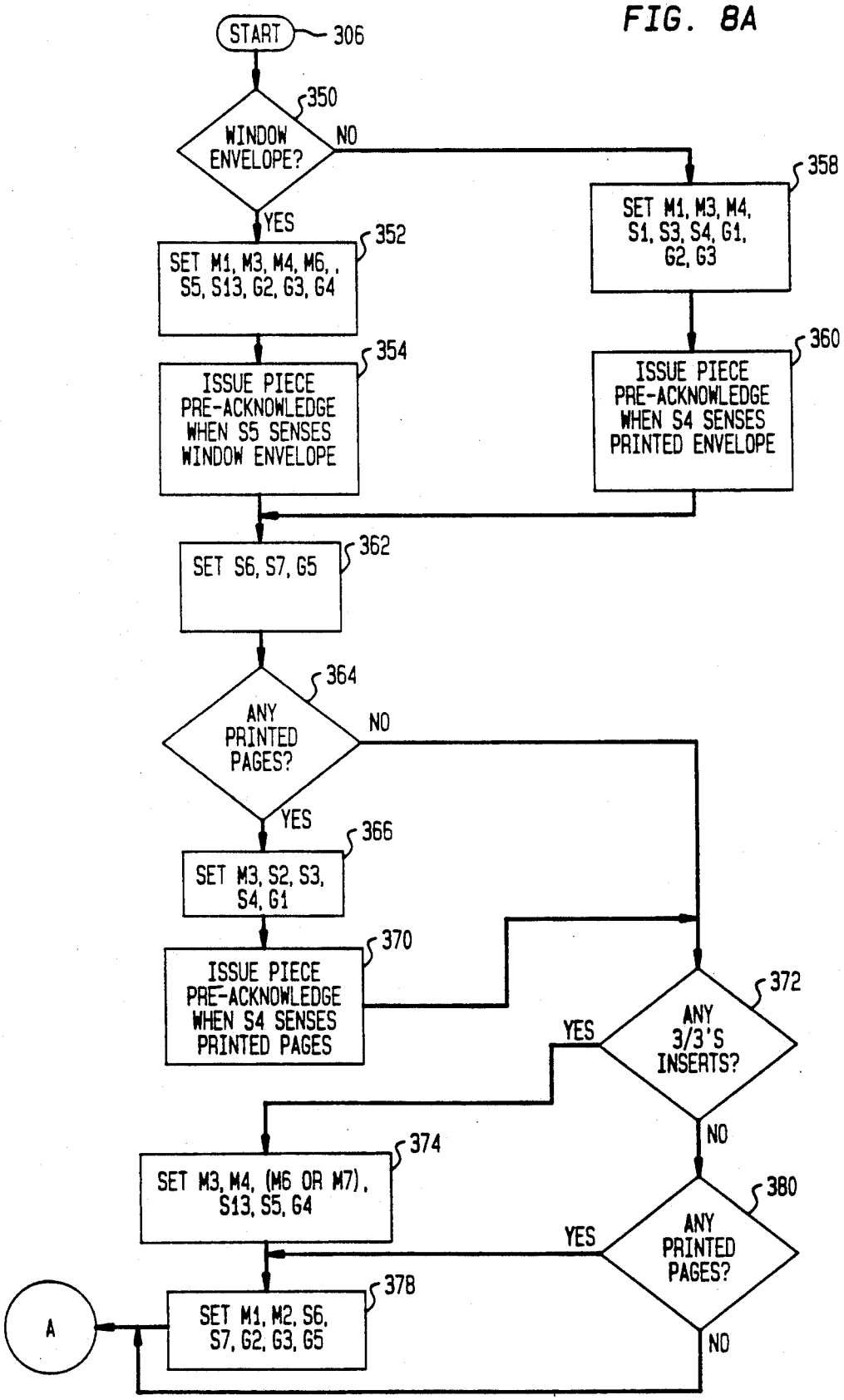
FIGS. 8A and 8B show a flow chart of the operation of the data processor of FIG. 1 in translating configuration information input by a user into a data structure for operation of the apparatus of FIG. 1.
Figure 8B:
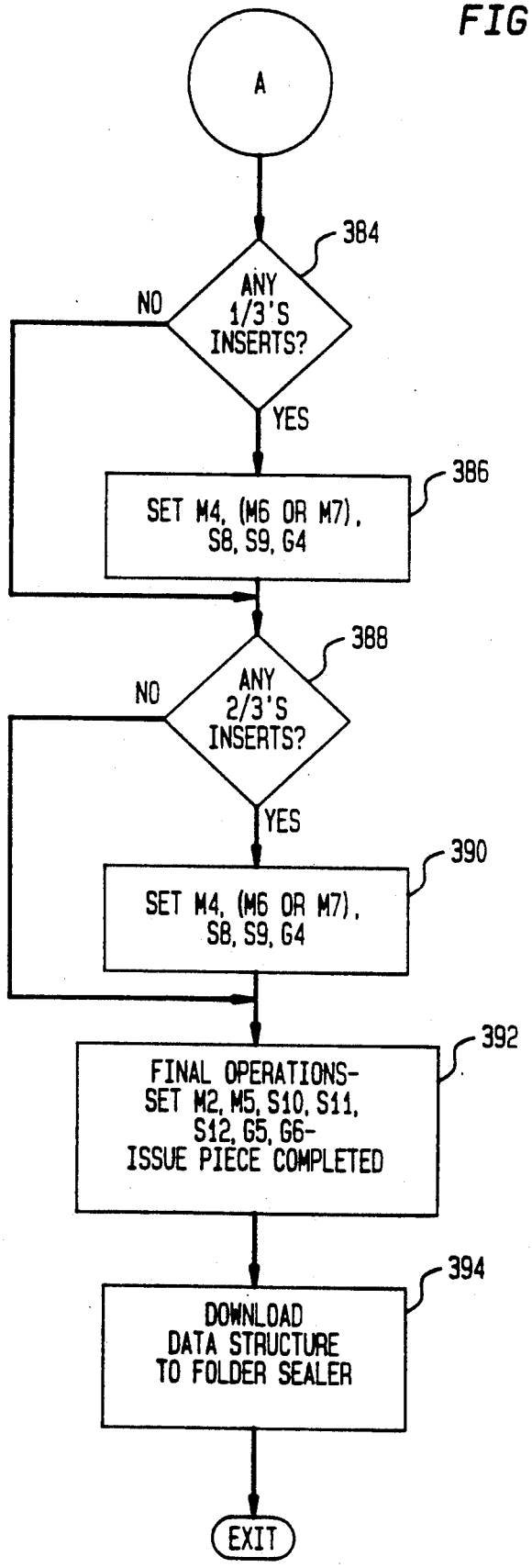

FIGS. 8A and 8B show a flow chart of the operation of the Control Application Program at 306 in translating the mail piece configuration defined by the user at 302 into a corresponding data structure. At 350 the program determines if the user has specified a window envelope. If a window envelope is specified, at 352 the Control Application Program specifies that motor M6 will turn on to feed window envelope form 10 from tray T3, and that motors M3 and M4 will be turned on to transport form 10 in accumulator folder apparatus 106. Gate G4 will be deactivated so that form 10 is not diverted from guides 120 onto guides 144. Motor M1 is specified to start to transport form 10 through assembly 106 so that it is further transported by motors M3 and M4 into the nip of accumulator folder apparatus 140. Gates G2 and G3 are specified so that form 10 is not folded, and sensors S5 and S13 are specified to monitor the flow of form 10 into assembly 106. At 354 the data structure is specified so that Piece Pre-Acknowledge is issued when form 10 is sensed by sensor S5.

If the user specified a non-window, printed envelope, at 358 sensors S1, S3 and S4 are specified to monitor flow of form 10 from laser printer 5 into assembly 106. Motors M1, M3 and M4 are specified to transport form 10 through apparatus 106 to the nip of assembly 140. At 360 the data structure is specified so that a Piece Pre-Acknowledge is issued when sensor S4 senses form 10.

In either event, at 362 the data is specified so that sensors S6 and S7 monitor the flow from assembly 106 to 140, and gate G5 is activated to align form 10 (either window or printed) and motor M2 is jogged to align form 10 in the nip of assembly 140.

This completes the data structure specifying operations on envelope form 10. Then, at 364 the Control Application Program determines if the user has specified any printed pages. If there are printed pages, at 366 motor M3 is specified to start to feed sheets after they are printed by printer 5, and sensors S2, S3 and S4 are set to monitor the flow of the sheet from tray T2 to accumulator folder apparatus 106. Gate G1 is specified to be deactivated so that the sheet will pass out of laser printer 5 into folder sealer six. At 370 the data is specified so that Piece Pre-Acknowledge issues when sensor S4 senses the sheet. Then, or if no printed pages were found at 364, at 372 the program tests to determine if any three-thirds pre-printed inserts have been specified by the user. If three-thirds inserts are specified at 374 motor M6 (or M7) will be specified to start to feed pre-printed sheets from tray T3 (or T4) and motors M3 and M4 will be started to transport the pre-printed sheets along guides 120 into the nip of accumulator folder assembly 106, where they will be accumulated with any printed sheets. Sensors S5 and S13 are specified to monitor the flow of the pre-printed inserts into the nip of apparatus 106, and gate G4 will be deactivated. Then, at 378, the data is specified so that motor M1 will be started to fold the printed and/or pre-printed sheets which have been accumulated. Gate G2 is deactivated so that the accumulated sheets will enter buckle chute 112 and gate G3 will be activated or deactivated depending upon whether a "C" or "Z" fold is specified. Sensors S6 and S7 monitor the flow of the folded accumulation of three-thirds sheets and gate G5 will be activated to laterally align the accumulated sheets with form 10 in the nip of assembly 140.

Returning to 372, if there are no three-thirds pre-printed inserts at 380 the program again determines if there were any printed pages, and if there were again goes to 378 to specify motors M1 and M2, sensors S6 and S7, and gates G2 and G3 and G5 as described above. If there were neither any three-thirds pre-printed inserts or printed pages, or after 378 if there were, the data specification for three-thirds pages is completed and the Control Application Program goes to 384 in FIG. 8B.

At 384 the program determines if any one-thirds pre-printed inserts or BRE's had been specified by the user. If any have, then at 386 the data is specified so that motor M7 (or M6) will be started to feed from tray T4 (or T3), and gate G4 is activated so that the insert or BRE is transported along guides 144 into the nip of the assembly 140. Motor M4 will be started to transport the insert or BRE. Sensors S8 and S9 will be specified to monitor the flow of the insert or BRE.

Whether or not there are any one-third inserts at 388 the program will determine if there are any two-thirds inserts. If there are, at 390 motors M4 and M6 or M7, sensors S8 and S9, and gate G4 will be specified as at 386.

This will complete provision of all the necessary parts of the configurations specified by the user, which will be accumulated at the nip of apparatus 140. At 392 the final operations common to all mail pieces are carried out. Motor M2 is specified to start to make the final fold in the mail piece, and motor M5 is specified to start to activate flap folder sealer 180 to fold the side and trailing flaps and finally seal the mail piece. Sensors S10, S11 and S12 are specified to monitor the flow of the mail piece, and gate G6 will be specified to moisten adhesive A on form 10. A Piece Completed message is specified when the completed mail piece is sensed by sensor S12.

Once the data structure is completed for the particular configuration specified by the user the completed data structure is downloaded to folder sealer 6 at 394.

The data structure developed by data processor 1, as described above, consists of from 1 to 4 data elements for each device active in processing a particular configuration, each data element including control parameters for specifying an operation to be performed by one of the sensors, motors, or gates shown in FIG. 6. Each data element is identified by an initial operation index value (or OP STATE) and includes a default initial state; that is the state the device will first enter when it is enabled unless another state is specified. The data element also specifies other devices and routines which are activated by the particular device associated with each data element. The data element specifies which devices are enabled or disabled and under what conditions during the operation of the particular device the other devices will be enabled or disabled. Each data element may also specify an alternative initial state for another device to be enabled. Each data element will also specify the next operation index value to indicate the next operation to be performed. If the corresponding device performs more than one operation; that is associated with more than one data element, an EXE- CUTE NEXT control byte is included in the associated data element indicating whether the next operation will be initiated immediately or the device will complete the first operation and return to an Idle State.

The set of data elements comprising the data structure which specifies the configuration selected by the user is executed by controller 6-1 to control the process of forming a mail piece. Controller 6-1 sequentially executes an Idle State to test each of the sensors, gates, or motors to determine if that device is enabled and for each such enabled device executes a state routine which corresponds to the current state and current operation index value for that enabled device. Devices which are not enabled remain in an Idle State.

Figure 9:
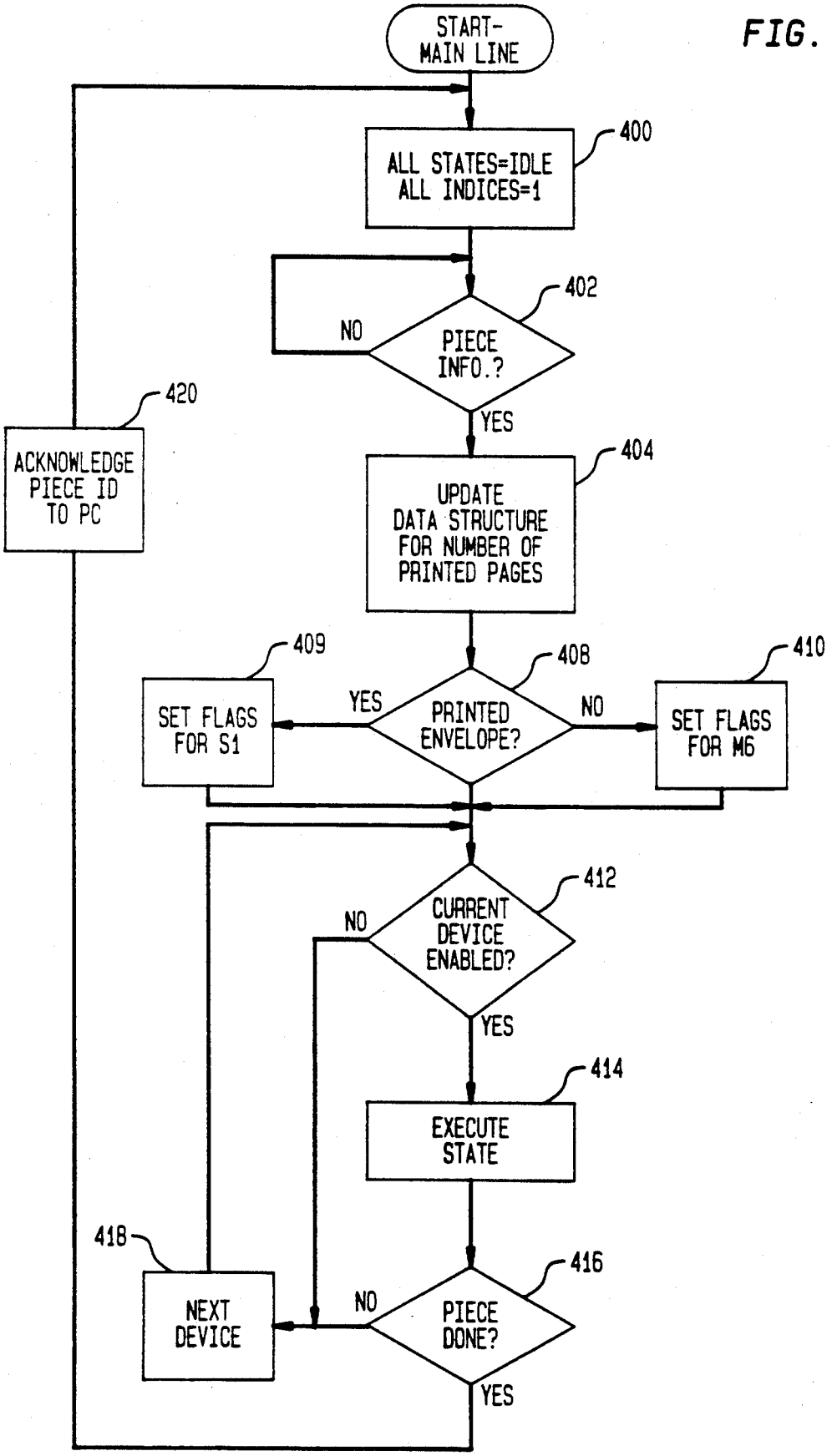
FIG. 9 shows a flow chart of the operation of the controller FIG. 4 in controlling the devices of FIG. 6 to produce a mail pieces.

FIG. 9 shows a flow chart of the mainline routine which tests each device in folder sealer 6, and sensors S1, S2 and S3, and gate G1 in laser printer 5; which, as noted operate under control of controller 6-1. After the data structure has been downloaded and controller 6-1 has responded to data processor 1, at 400 all devices are in an Idle State and all operation index values are set equal to 1. At 402 controller 6-1 waits for initial piece information from data processor 1. This piece information includes a mail piece identification number, which may be used in recovering from a paper jam or error condition; the number of printed pages included in a particular mail piece, which as noted above may be variable; and the identification of the particular device which will initiate operation on that mail piece. That is, depending upon whether the mail piece has a non-window, printed envelope or a window envelope, operations on the mail piece will commence either when sensor S1 detects a non-window form 10 being fed from tray T1 as data processor 1 initiates printing, or controller 6-1 will energize motor M6 to feed a window envelope form 10 from tray T3. When the piece information is received, at 404 the data structure is updated for the number of printed pages, as will be described further below. It should be noted that only the number of printed pages is allowed to vary, and that in the preferred embodiment described those data elements related to assembling pre-printed sheets and BRE's are fixed in each configuration for a mail run. At 408, depending upon whether the mail piece includes a printed envelope form 10 or a window envelope form 10, the program will either set flags to enable sensor S1 at 408 or set flags to enable motor M6 at 410. In either case, at 412 the mainline routine will be activated to sequentially execute the Idle State for each device to test the devices to identify those which are enabled. If the device currently tested is enabled, at 414 the device state routine corresponding to the present operational index and state for that device is executed. At 416 the routine determines if the mail piece has been completed, and if it has not, at 418 indexes to the next device and returns to 412. If the mail piece has been completed controller 6-1 acknowledges completion by transmitting the piece identification to data processor 1, at 420, and returns to 402. The mainline routine will remain in a loop until the mail run is complete and the system is reset.

Alternatively to downloading a new configuration for each mail run a JOB created on the user's application program may be output as a mail run using a previously stored configuration in a matter essentially identical to that described above.

Figure 10A:
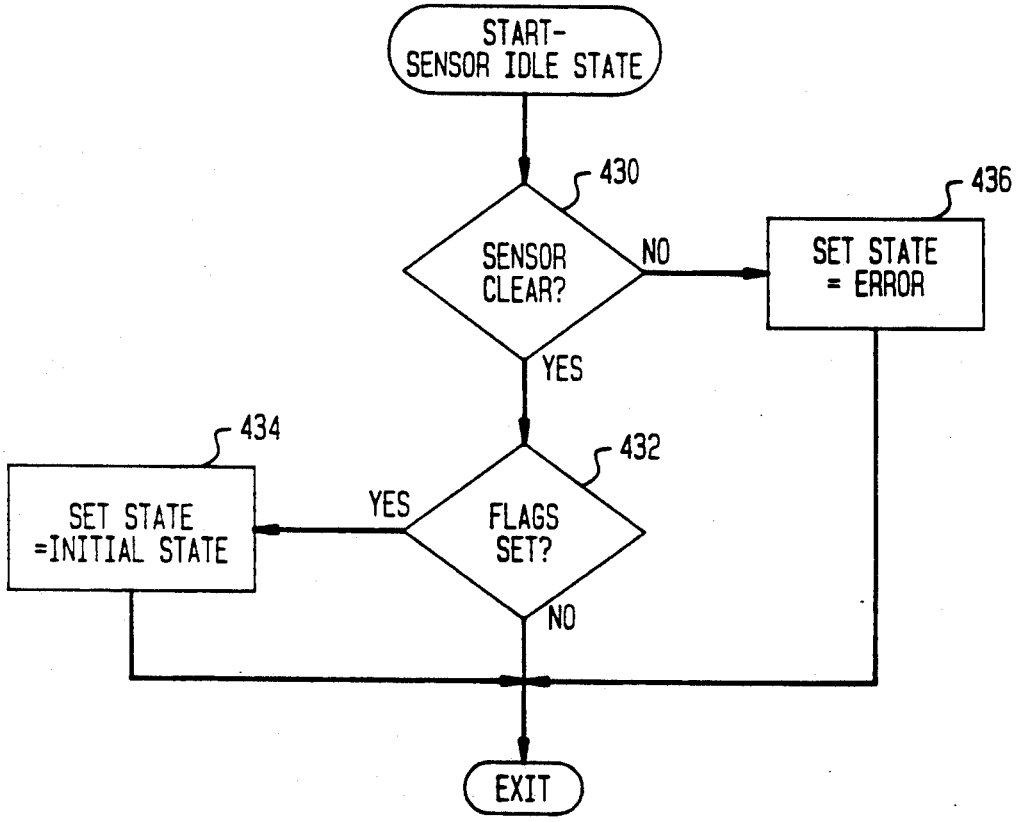
FIGS. 10A through 10H show flow charts of State Routines for sensors shown in FIG. 6.

FIGS. 10A–10H show the state routines for sensors. FIG. 10A shows the sensor's Idle State, where at 430 the routine tests to determine if the sensor is clear. If it is clear, at 432 the routine tests to determine if the flags for the corresponding sensor are set; that is if the corresponding sensor is enabled. If the corresponding sensor is enabled at 434 the state is set to be the Initial State, either as defined in the current OP STATE or as specified by the controlling device which has enabled the corresponding sensor. Controller 6-1 than exits the routine and returns to the mainline program. If, at 430, the sensor is not clear at 436 the state is set to equal Error State and the routine exits.

Figure 10B:
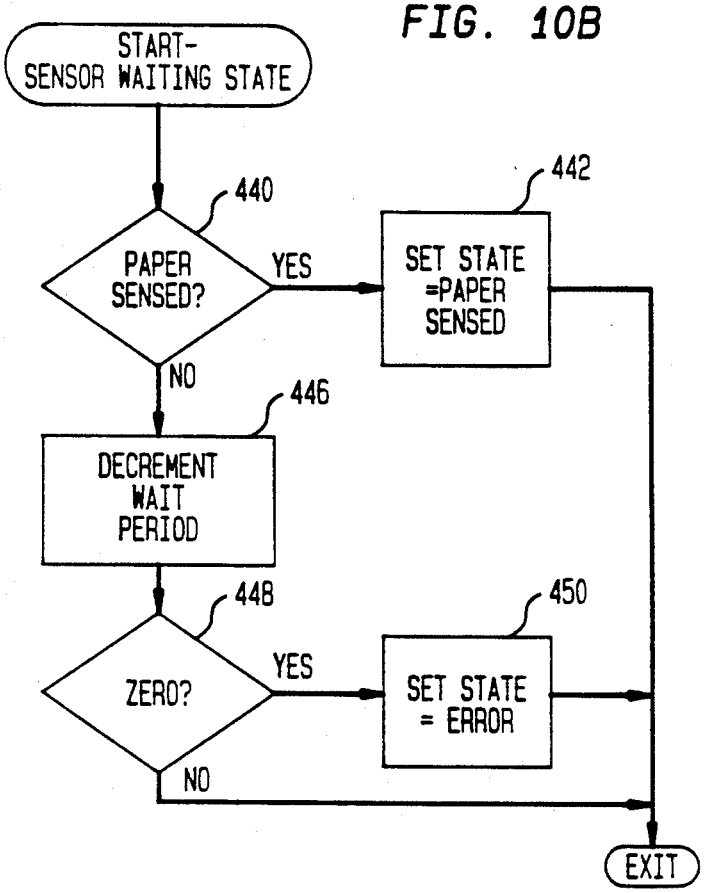

FIG. 10B shows the sensor Waiting State, which is the normal default state for all sensors. At 440 the routine tests to determine if paper has been sensed. If it has, at 442 the state for the corresponding sensor is set to be equal to Paper Sensed and the routine exits. If no paper is sensed, at 446 a wait period is decremented and at 448 the routine tests to determine if the wait period has expired. If it has at 450 the state is set to be equal to Error and the system exits, otherwise the system exits at 448.

Figure 10C:
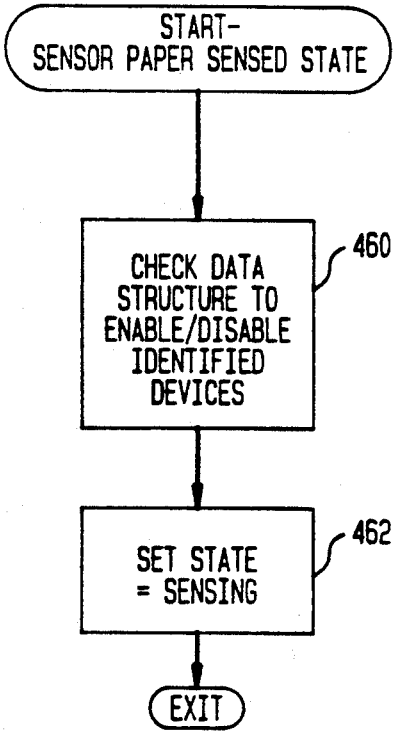

FIG. 10C shows the sensor Paper Sensed State. At 460 the routine checks the data structure to access the data element corresponding to the current OP STATE for the corresponding sensor to enable or disable devices and routines identified in the corresponding data element. Than at 462 the state is set equal to Sensing and the routine exits.

As noted above in the preferred embodiment described herein devices are enabled by setting corresponding flags. Preferably two flags are provided so that devices may be enabled by logically "anding" the occurrence of two events. Similarly, the device may be disabled by resetting these flags.

Figure 10D:
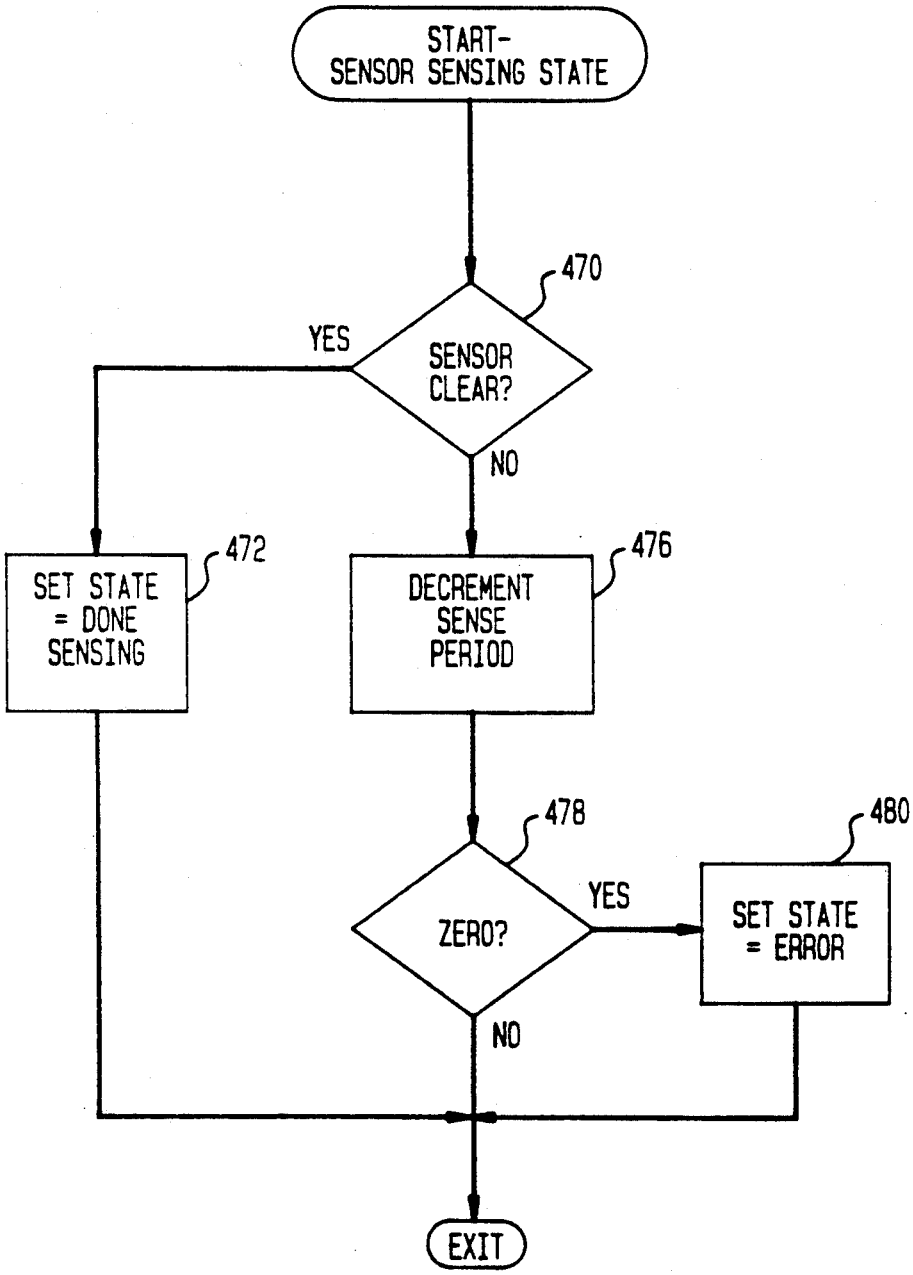

FIG. 10D shows the sensor Sensing State. At 470 the routine tests to determine if the sensor is clear. If it is, at 472 the state is set to equal Done Sensing and the routine exits. If the sensor is not clear at 470, at 476 the Sense Period is decremented and at 478 the routine determines if the period has expired. If it has, the state is set equal to Error at 480 and the routine exits, otherwise the routine exits at 478.

Figure 10E:
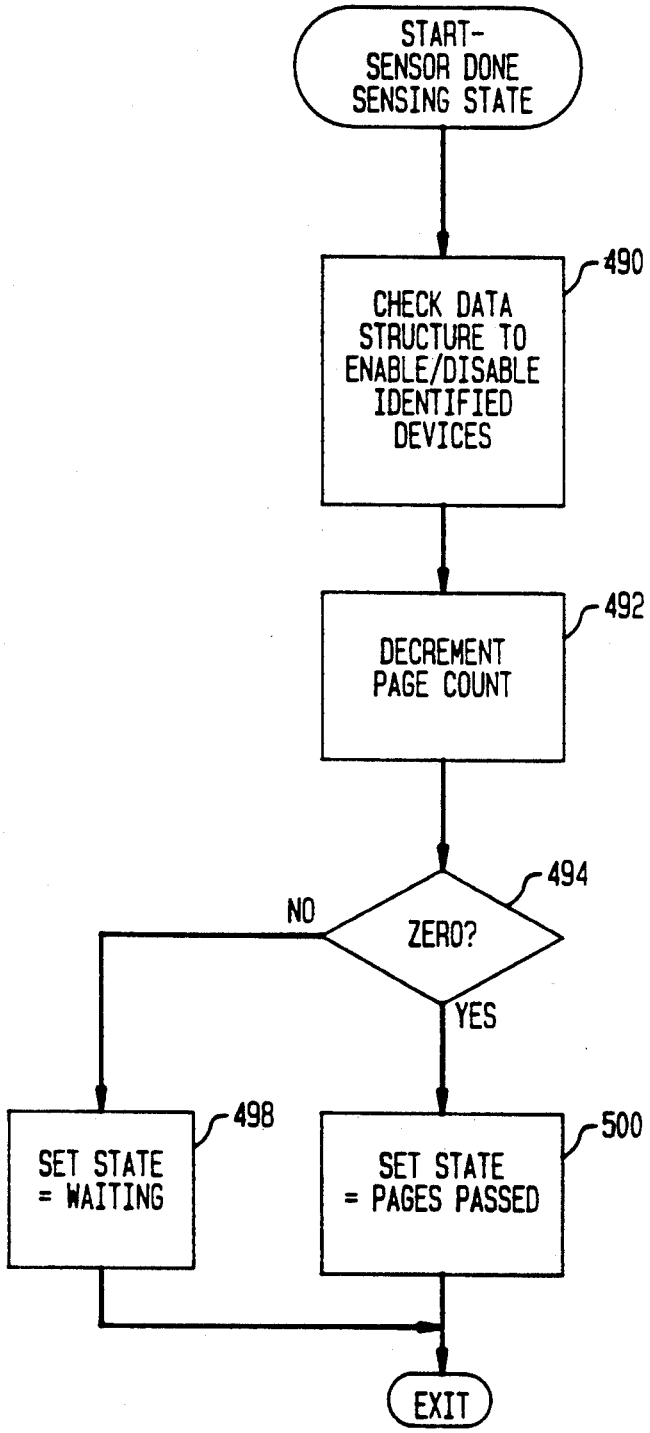

FIG. 10E shows a flow chart of the sensor Done Sensing State. At 490 the routine again checks the corresponding data element in the data structure to identify devices and routines to be enable or disabled. Than at 492 the associated page count is decremented. As noted above if the current OP STATE relates to processing printed pages this page count may be varied for each mail piece in accordance with the piece information transmitted from data processor 1. For other sheets the page count will remain constant through a mail run. Than at 494 the routine tests to determine if all pages have been processed, If not, than at 498 the state is set equal to waiting and the system exits. If all pages have been processed the state is set equal to Pages Passed at 500, and the routine exits.

Figure 10F:
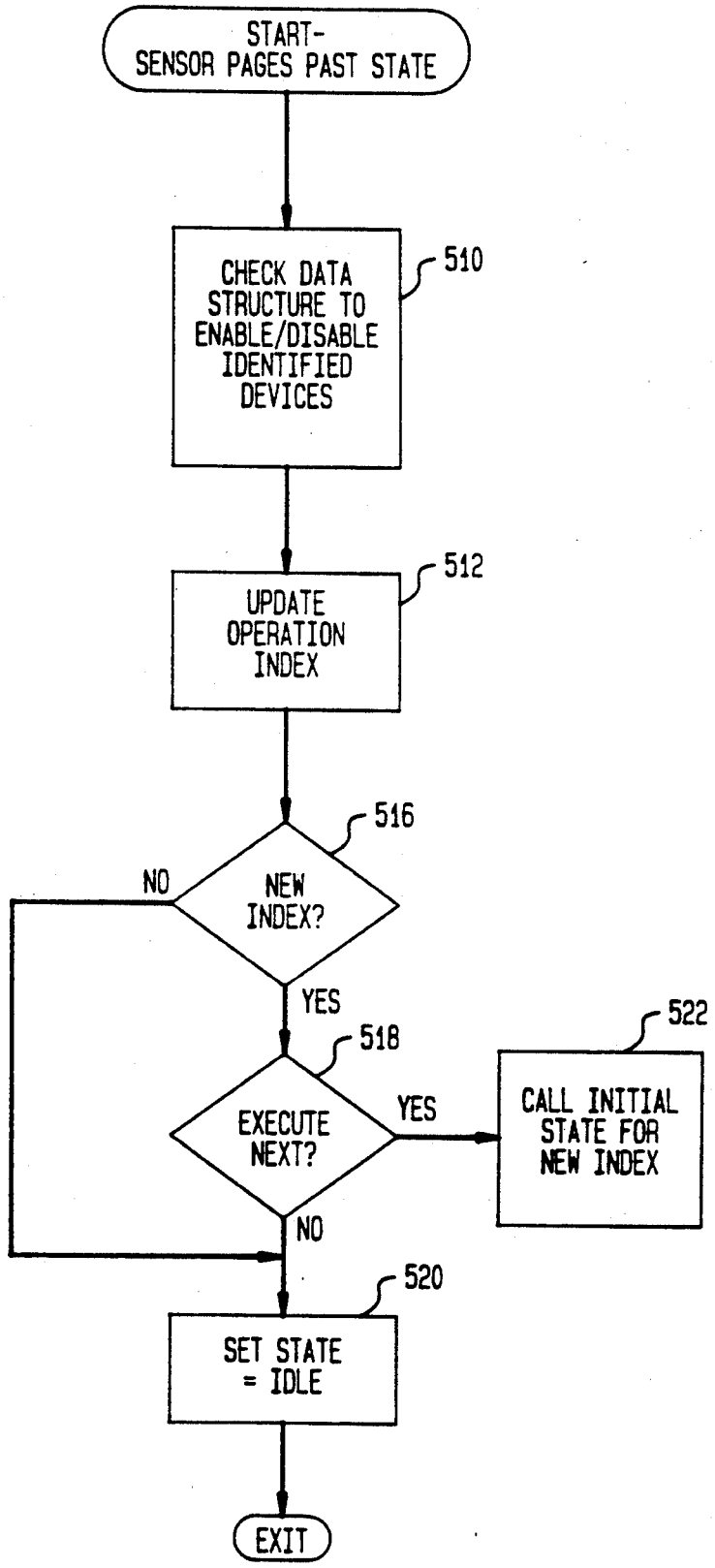

FIG. 10F shows the sensor Pages Passed routine. At 510 the routine again accesses the corresponding data element to enable or disable identified devices and routines. At 512 the routine accesses the data element to update the operation index value, and 516 determines if there is a new index value. If there is, at 518 the routine determines if EXECUTE NEXT is set. If EXECUTE NEXT is not set, or if at 516 the index value is not changed, the state is set equal to Idle State the flags are cleared and the system exits. If EXECUTE NEXT is set, than at 522 the routine directly calls the Initial State for the new operation index value.

Figure 10G:
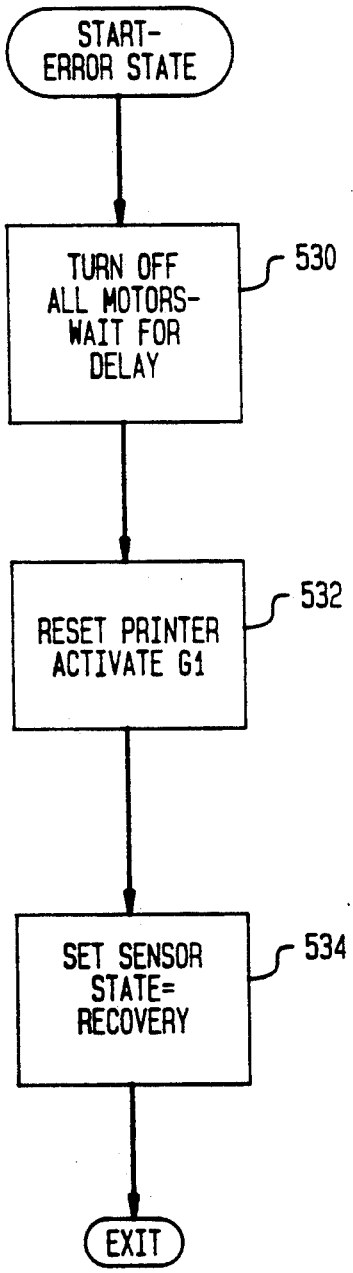

FIG. 10G shows the Error State, which is the same for all error conditions At 530 the routine turns off all motors and waits for a predetermined delay. At 532 controller 6-1 resets printer 5 and activates gate G1 to divert any following printed sheets from folder sealer 6. At 534 the routine sets the state equal Recovery.

Figure 10H:
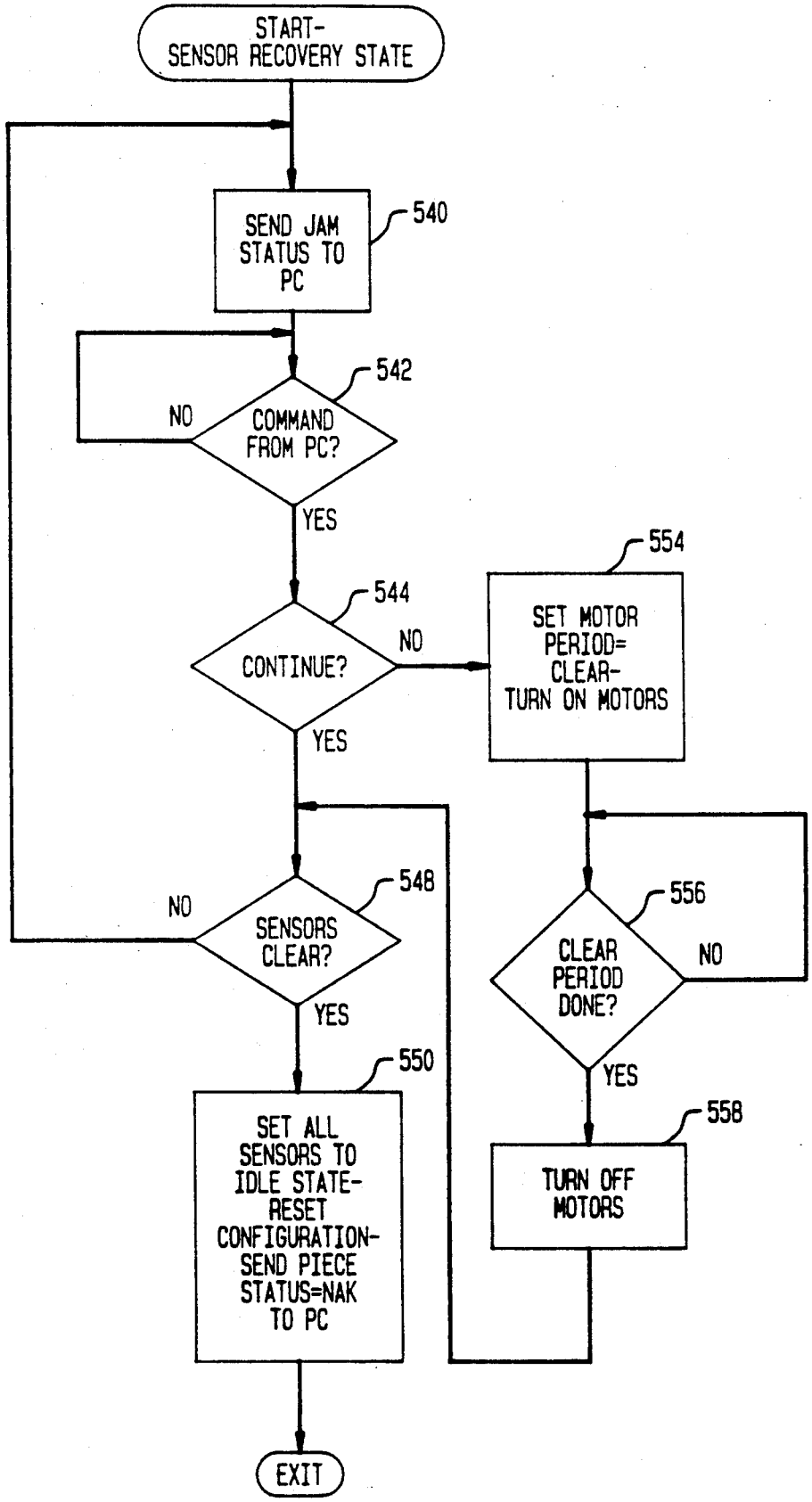

FIG. 10H shows the sensor Recovery State. At 540 the routine sends a jam status to data processor 1 and 542 waits for a command from data processor 1. At 544 the routine determines if the command is Continue, and if so at 548 determines if all sensors are cleared. If all sensors are not clear the routine returns to 540 and again sends status to data processor 1. If all sensors are clear, at 550 all sensors are set to Idle State the data structure defining the configuration for the mail run is reset and a Not Acknowledge piece status is sent to data processor I to indicate that processing of the identified mail piece was unsuccessful. If at 544 the command is not Continue then at 554 the motor periods are set to a predetermined clear period and all motors are turned on to attempt to automatically clear the jam. At 556 the routine waits to determine if all motors have run for the clear period and than at 558 turns off all motors. The routine than goes to 548 to test if all sensors are clear; i.e. if the jam has been cleared, if the jam is successfully cleared the routine again goes to 550 and exits. Otherwise the routine returns to 540 and initiates the recovery process again.

FIG. 11A shows the motor Idle State. At 600 the routine tests to determine if both flags are set for the motor corresponding to the device currently being tested by the mainline program. If the flags are set than at 602 the motor state is set equal to the Initial State, either as specified by the controlling device or as defined as the default state by the corresponding data element. Also the motor phase and direction are set. If, at 600, the flags are not set than 604 the routine assures that the corresponding motor is stopped, and in either event the routine then exits.

FIG. 11B shows a flow chart for the motor Starting State. At 610 the routine checks the corresponding data element and enables or disables the identified devices and routines. At 612 the motor state is set equal to Running.

Note that normally the Starting State will be the default Initial State for all motors.

Figure 11C:
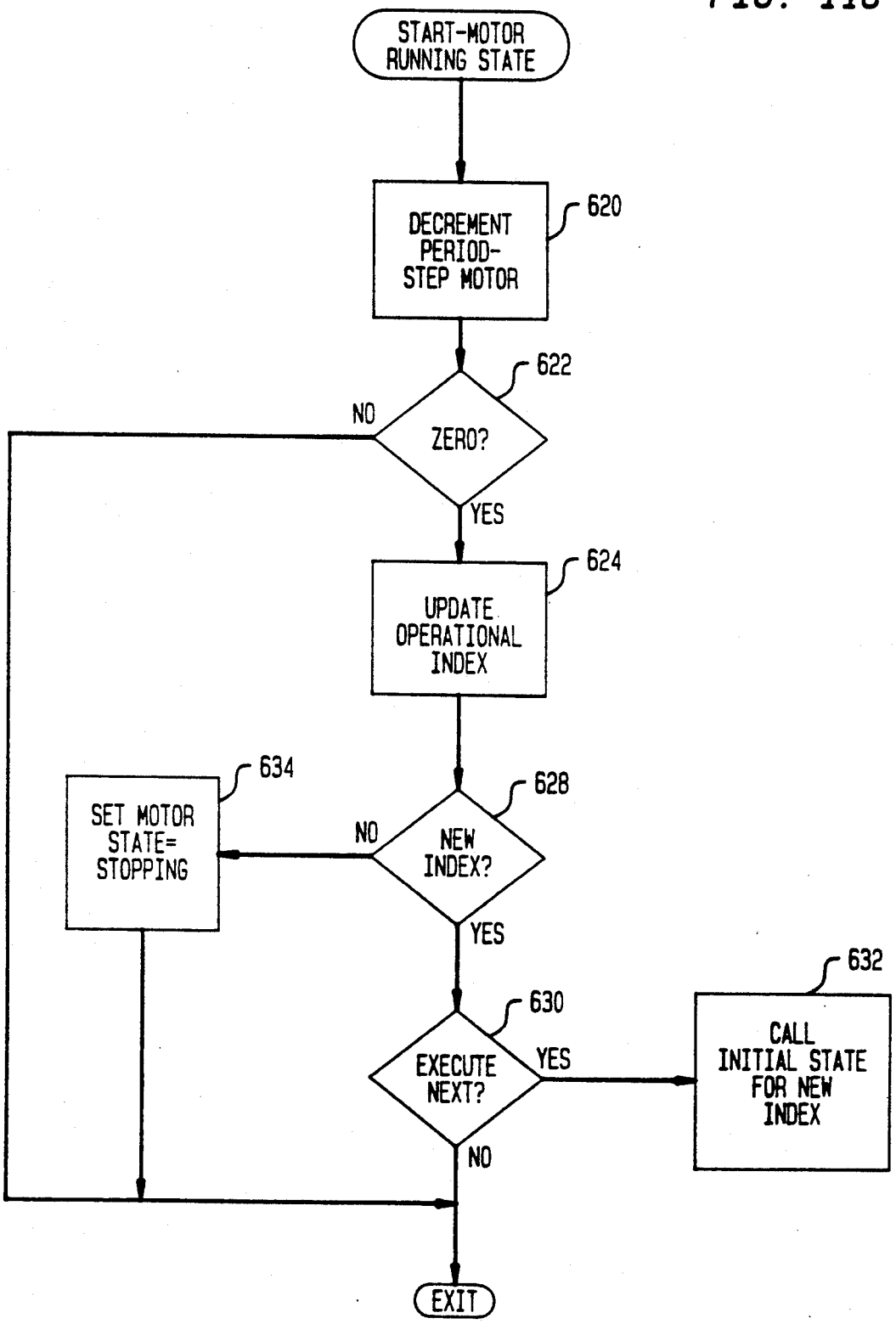

FIG. 11C shows a flow chart for the motor Running State. At 620 a predetermined motor period is decremented and the motor is stepped along a predetermined velocity profile.

As motors M1 and M2 are conventional stepper motors it is well known that they are readily driven on a wide range of velocity profiles by conventional means, which need not be described here for an understanding of the subject invention.

Typically the velocity profile for motors M3 through M7 will be conventional trapezoidal profiles. Thus, though stepper motors may be used, conventional AC/DC motors will perform acceptably for M3 through M7, and are probably preferable for reasons of cost. However, in accordance with preferred embodiments of the subject invention the velocity profiles for motors M1 and/or M2, which drive accumulator folder assemblies 106 and 140 respectively, will cause the velocity to decrease at the point where accumulated sheets are being folded in order to increase the torque while sheets are being folded. These profiles also include a decrease in velocity as the folded sheets exits accumulator folders 106 and 140 to facilitate a smooth hand off of the folded sheets to the next operation.

Next the routine, at 622, tests to determine if the running period is finished. If it is, then at 624 the routine updates the operational index value in accordance with the corresponding data element. At 628 the routine determines if there is a new index. If there is, at 630 the routine determines if EXECUTE NEXT is set. If it is not the routine exits. If it is set, then at 632 the initial state for the new operation index value is directly called. If at 628, the index value remains unchanged, then at 634 the motor state is set equal to Stopping and the routine exits. If at 622 the running period is not completed then the routine again exits.

Figure 11D:
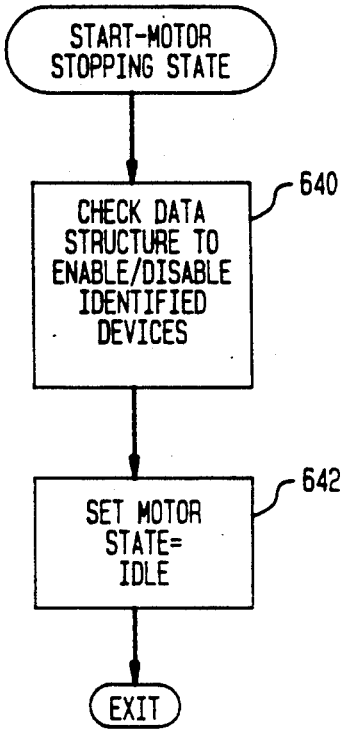

FIG. 11D shows the motor Stopping State. At 640 the routine checks the data structure to enable or disable devices and routines identified by the corresponding data element. At 642 the motor state is set equal to Idle State and the flags are reset.

Figure 11E:
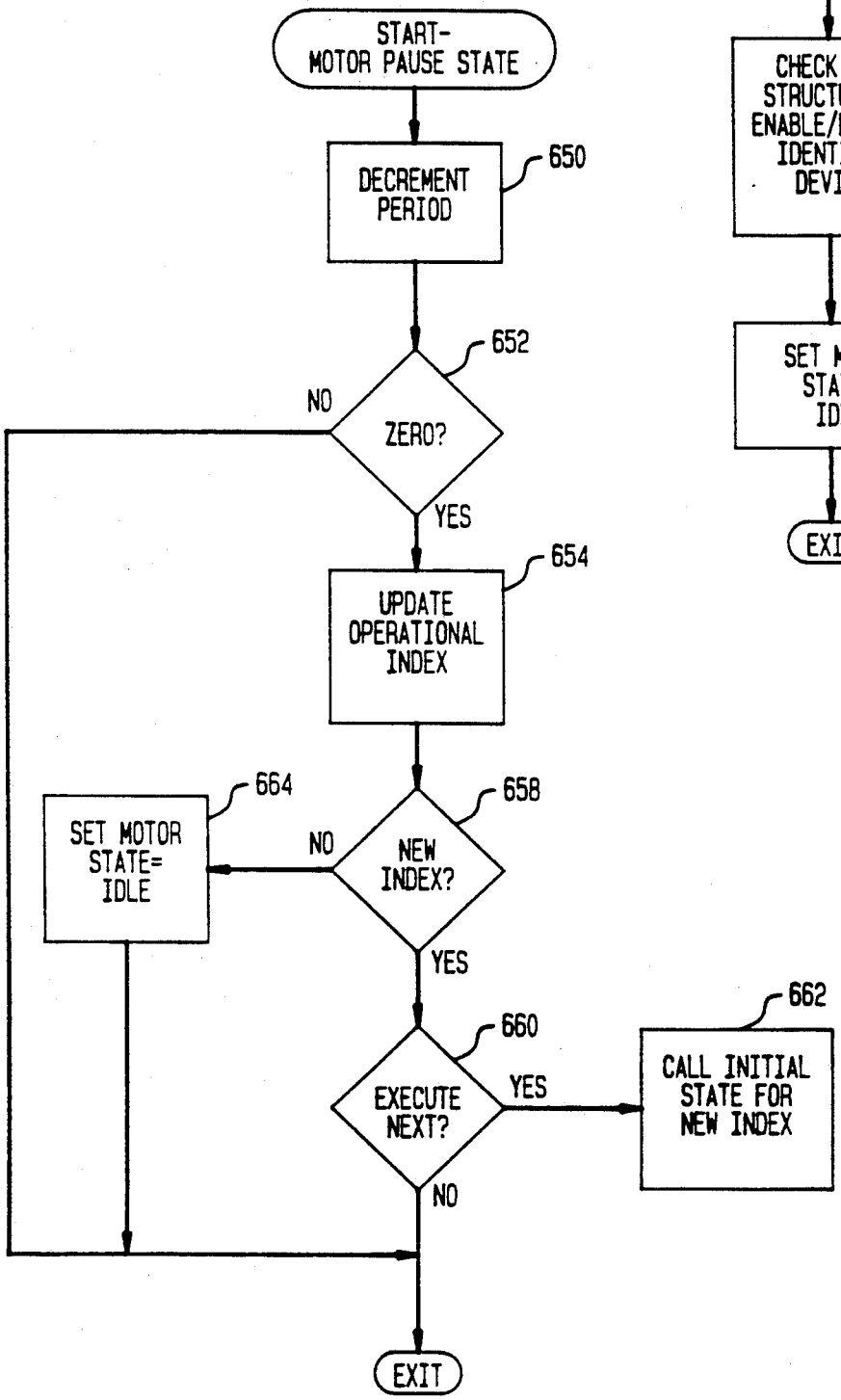

FIG. 11E shows the motor Motor Pause State. The sequence of the routine for this state is substantially similar to motor Running State shown in FIG. 11C, however the motor is not operated while the Motor Pause State is active. This state is initiated for timing purposes to allow a predetermined delay before a new operation index value is started.

Figure 12A:
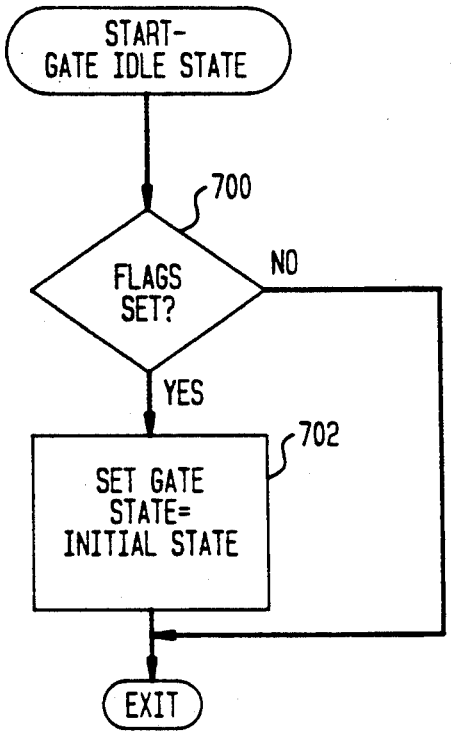
FIGS. 12A through 12E shows flow charts of State Routines for gates shown in FIG. 6.

FIG. 12A shows a flow chart for the gate Idle State. At 700 the routine checks to determine if all flags are set for the gate corresponding to the current device. If the flags are set than at 702 the gate state is set equal to the Initial State, and in either case the routine than exits.

Figure 12B:
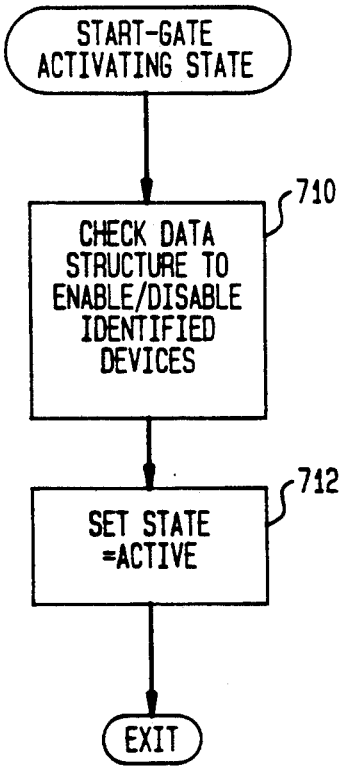

FIG. 12B shows a flow chart of the gate Activating State; the normal default state. At 710 the routine checks the data structure to enable or disable devices and routines identified in the corresponding data element, and at 712 the state is set equal to Active.

Figure 12C:
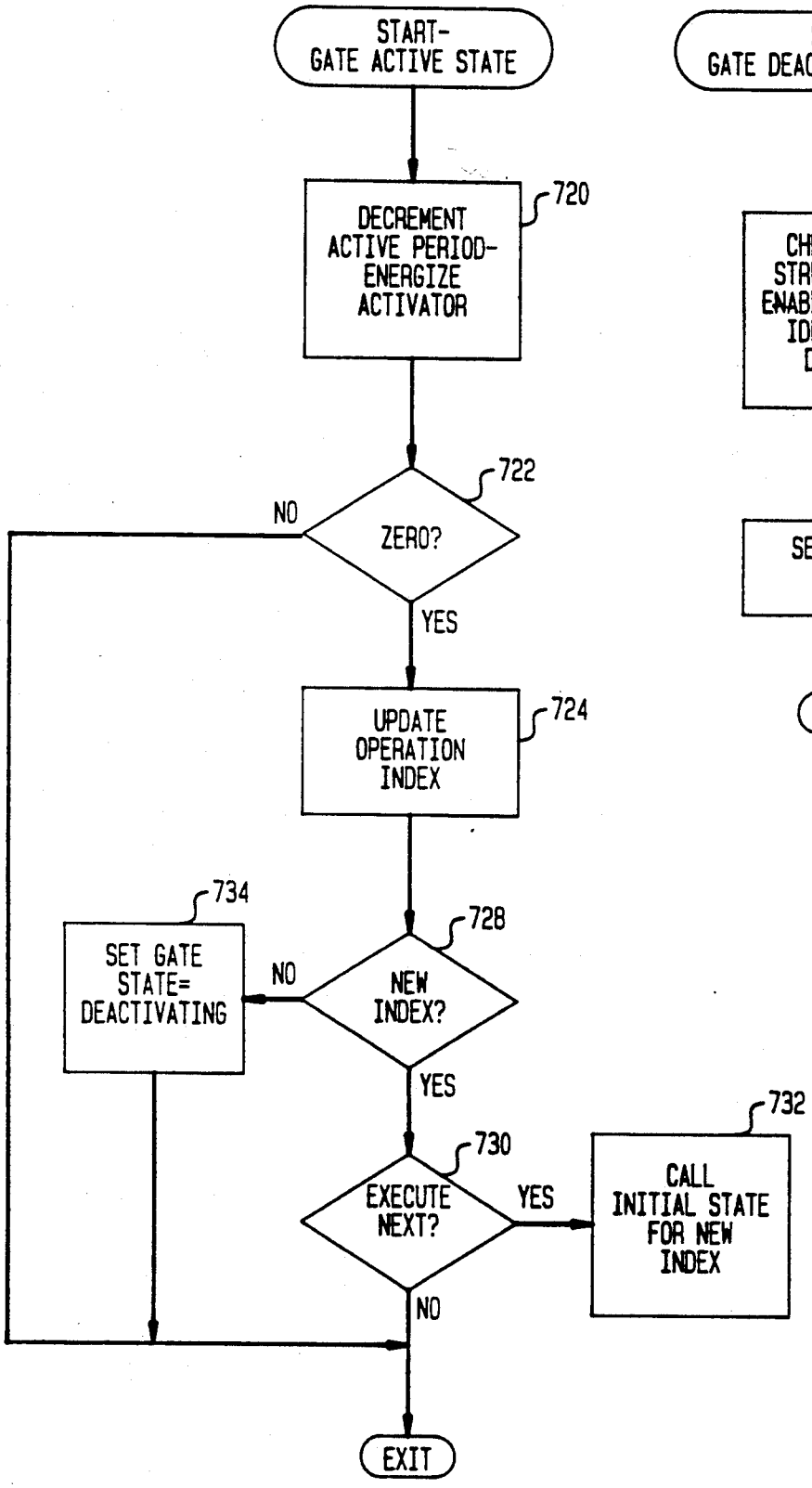

FIG. 12C shows the gate Active State. At 720 the gate active period is decremented and the activator for the corresponding gate is maintained in an energized state. At 722 the routine determines if the active period is finished. If it is, then at 724 the routine updates the operation index value, then at 728 determines if a new index value has been set. Then, at 730, the routine determines if EXECUTE NEXT is set. If it is not the routine exits. If EXECUTE NEXT is set the routine directly calls the Initial State for the new operation index value, at 732. If at 728 the index value remains unchanged then at 734 the gate state is set equal to Deactivating and the routine exits. If at 722 the period is not finished the routine exits.

Figure 12D:
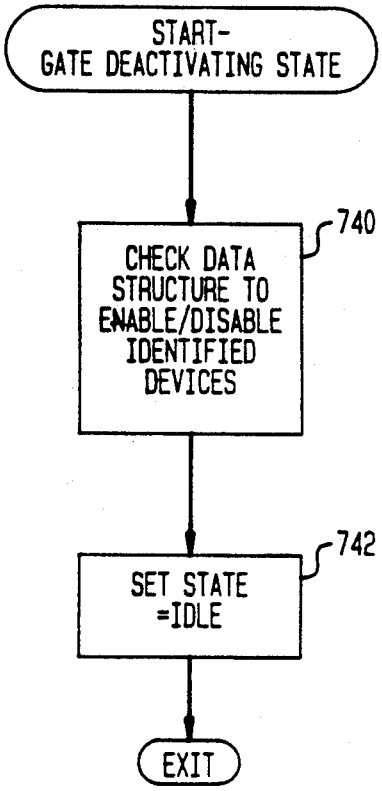

FIG. 12D shows a flow chart for the gate Deactivating State. At 740 the routine checks the data structure to enable or disable identified devices or routines in accordance with the corresponding data element, and at 742 the state is set equal to Idle and the flags are reset and the routine exits.

Figure 12E:
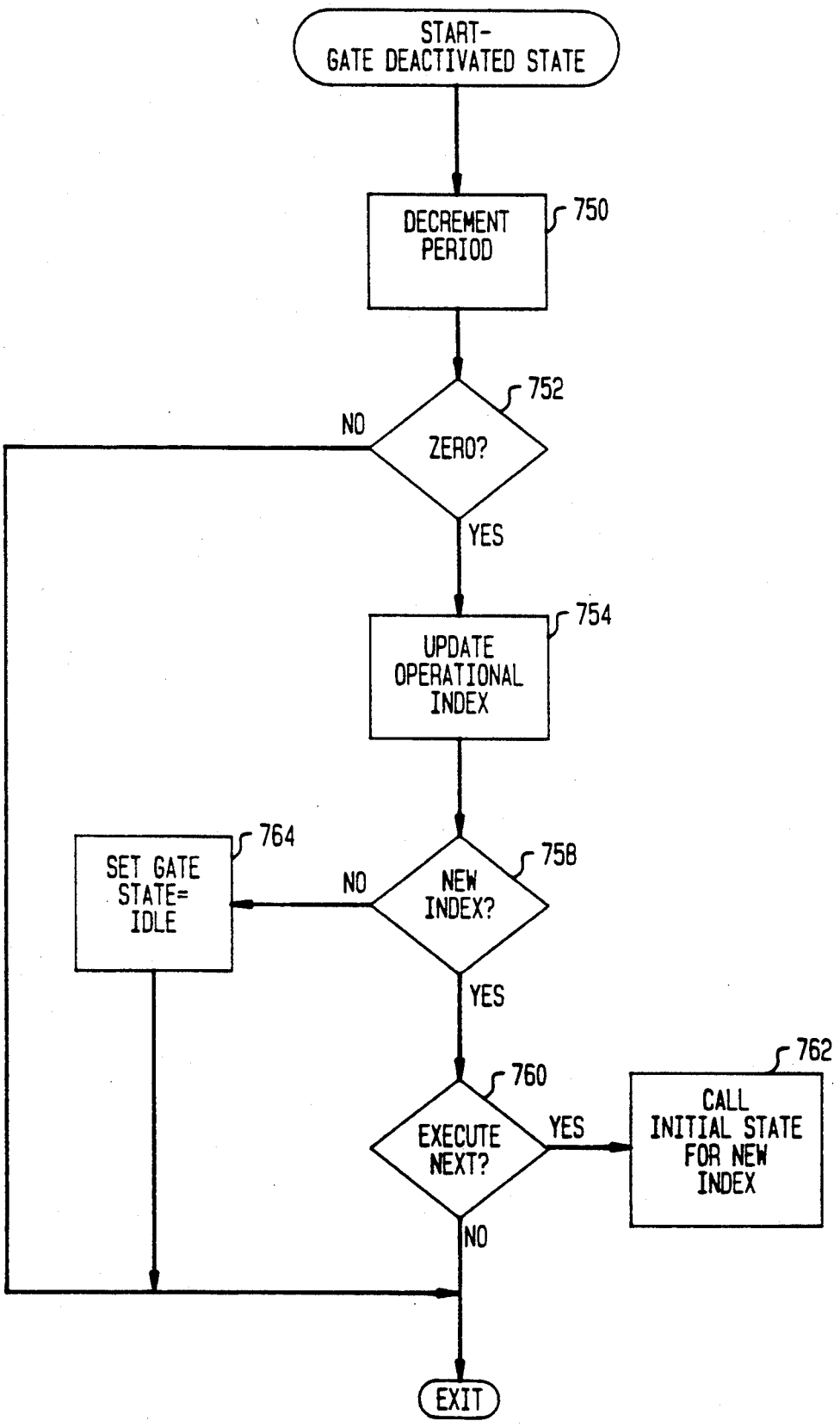

FIG. 12E shows a gate Deactivated State. This state is provided to allow the system to pause for predetermined period before initiating a new OP STATE for the corresponding gate and its sequence is identical to the gate Active State shown in FIG. 12C, except that the actuator for the corresponding gate is not energized.

It should be noted that the above states include various preset periods to determine the timing of the operation of the corresponding devices. The approximate values for the values of these periods may be determined from a knowledge of operating speeds of the system and the geometry of the various sheets to be processed. These approximate values may than be readily optimized for peak performance by a person in ordinary skill in the art through a simple process of trial and error.

In addition to activation of other state routines state routines may directly call Check Excess Pages, Piece Pre-Acknowledge, or Piece Completed routines; which are simple routines for communicating status to data processor 1 and testing the configuration against the allowed limits. These routines need only be described briefly for an understanding of the subject invention. Check Excess Pages tests the data structure to determine if the specified number of pages, both printed and pre-printed, is greater than the maximum allowed, three pages. If it is the routine activates gate G1 to divert the printed pages and or any printed form 10, deactivates folder sealer 6 and sends acknowledgement to data processor 1. Piece Pre-Acknowledge sends acknowledge to data processor 1 when a sheet is detected by a selected sensor, Pieces Completed sends an Acknowledge signal to data processor 1 when the mail piece is completed. The Piece Completed routine sends the Piece Identification to data processor 1.

Table 1 shows the information included in each data element and the data structure. Each data element identifies the device with which it is associated and a default Initial State in which that device will begin operation; unless otherwise specified by the activating device. The table also specifies the initial Operation Index Value for those devices which perform more than one operation. As discussed above, each device is capable of activating other devices and each data element specifies the other devices activated by the associated device, if any, in terms of activating conditions (i.e. State Routine during which the other device is to be activated), and an optional Initial State different from the default state for the controlled device. The data element also specifies the next value of the Operation Index Value and the conditions under which the device will proceed to the next Index Value.

As discussed above, for sensors, the conditions under which the next operation is begun are page counts, which may be variable within a given mail run. For each piece, data processor 1 transmits the piece information; which for printed pages may be variable. In this case controller 6-1 will vary the page count for sensors 3 and 4 as the printed page count is varied from mail piece to mail piece in a give job run.

Also associated with the next Operation Index Value is EXECUTE NEXT flag byte which, when set, indicates that the next operation will begin immediately. When not set the device returns to the Idle State and waits for activation by another device before commencing the next operation.

Certain fixed, or system, parameters are also associated with each data element to specify operation characteristics such as delays. As discussed above, these system parameters may be easily estimated from the operating characteristics of a given then adjusted for optimal performance by a simplay process of trial and error. Once determined these parameters remain fixed unless the operating characteristics of the system are changed. The fixed parameters are set whenever the system is initialized and may either be set in data processor 1 and transferred with each data element, or set in system controller 6-1 and identified by appropriate pointers in the data elements.

Table 2 shows the configuration information entered by the system user to specify the mail piece configuration for a given mail run. This information includes the tray which will act as the source, the sheet type for each tray, and the number of sheets to be included in each mail piece from each tray. As discussed above, for printed sheets this number may be variable and data processor 1 will determine the number of printed sheets for a mail piece and include that information with the piece information.

The configuration information also includes information for determining the address for each mail piece. Preferably, this is done by having the system user identify a field within the document format used in the JOB. The Control Application Program will then cause the information in this field to be printed on the envelope form and/or appropriate pages in the mail piece. The ability to extract address information from designated fields is well known in the art, and for example is found in many commercially available word processing programs, and need not be discussed further here for an understanding of the subject invention.

The following Example illustrates the relation between a data structure and the corresponding mail piece configuration.

TABLE 1

Data Elements

1. Device (type, ID)
2. Default Initial state (state routine name)
3. Operation Index Value (Op State No.)
4. Other devices controlled (activating condition, controlled device, optional initial state)
5. Next Operation Index Value (Op State No., activating condition, execute next flag)
6. System Parameters (delays, motor velocity profiles, etc.)

TABLE 2

Configuration Information

1. Source (tray No.)
2. Sheet type (window envelope, printed envelope, 3/3's, 2/3's printed sheet, 3/3's, 2/3's, 1/3's pre-printed sheet, or BRE)
3. Number of sheets (No., variable)
4. Addresses Information (text block)

HYPOTHETICAL EXAMPLE

This example illustrates the operation of the system of the subject invention in producing a mail piece which has a printed (non-window) envelope, fed from tray T1, one printed three-thirds page, fed from tray T2, one pre-printed two-thirds insert fed from tray T4, and one one-thirds pre-printed insert fed from tray T4. These sheets and envelope form may be formed into mail a piece in accordance with the example data structure set forth below.

Overall the entire process involves:

1) printing the envelope in printer 5 and positioning it at the nip of accumulator folder assembly 140; aligning it by activating registration gate G5, and jogging motor M2 to engage envelope form 10.

2) printing the three-thirds page from tray T2 in printer 5; making a three-thirds to two-thirds "C" fold in the three-thirds sheets by accumulator folder assembly 106; and accumulating the three-thirds sheets with envelope form 10 at the nip of a assembly 140; and aligning it by again operating gate G5.

3) the one-thirds pre-printed sheet (which may be a BRE) is fed from tray T4; followed by feeding the two-thirds pre-printed sheets from tray T3, for accumulation with envelope form 10 and the printed three-thirds sheets.

4) once all sheets are in the nip of assembly 140 motor M2 is turned on and the accumulation is folded approximately in half, from two-thirds to one-third.

5) trailing flap folder sealer assembly 180 is activated to fold and seal trailing flap 112 and side flaps 114 and the completed mail piece exits.

The above described operation is set forth in terms of the operation of the sensors, motors, and gates of the subject invention below. As each operation (step) is described the corresponding data elements are identified parenthetically.

Steps:

0) Since the first element of the mail piece is a printed envelope form 10 to be fed from tray T1 the mainline program activates sensor S1.

1) (S1, Op. St. 1) Envelope form 10 is fed from tray T1 and printed by printer 5. When sensor S1 detects form 10 it activates sensor S3. When sensor S1 determines that one page has passed it returns to the Idle State.

2) (S3, Op. St. 1) When form 10 is detected by sensor S3 it activates motor M3 and sensor S4, and calls the CHK. EX. PGS. routine to determine if the number of pages specified exceeds the maximum allowed by the system, as described above. If the number of pages exceeds the maximum form 10 when the printed pages are diverted to the top of the printer by gate G1 to allow the operator to intervene and salvage the otherwise unprocessable mail piece. Assuming that the specified mail piece is correct the operation continues and after one page (i.e. form 10) has passed the next Op. St. is specified as 2 and the routine exits to the Idle State.

3) (S3, Op. St. 1) When sensor S4 senses form 10 it activates motor M3 to assure that the motor M3 is on. After it detects one page passed sensor S4 activates motor MI and sensor S2 to prepare for the printed three-thirds page). After one page (i.e. form 10) has passed the next Op. St. is set equal to two and the routine exits.

4) (M1, Op. St. I, Op. St. 2) Motor M1 first executes a Motor Pause State and than EXECUTES NEXT to Op. St. 2 to Start. When motor M1 is Starting it activates sensor S6, gate G3 and gate G2. When it is done running it exits to the Idle State.

5) (S6, Op. St. I) Sensor S6 activates sensor S7 and motor M4 when its senses form 10 and sets gate G2 to the Deactivating State after form 10 has passed. (Accumulator form 106 is now conditioned to fold the following three-thirds printed page.) After one page has passed the next Op. St. is set equal to 2 and the routine exits to the Idle State.

6) (S7, Op. St. 1) After one page has passed (form 10) sensor S7 sets motor M1 to the Stopping State and activates gate G5 (the registration gate). After one page is passed the next Op. St. is set equal to 2 and the routine exits to the Idle State.

7) (G5, Op. St. 1) After gate G5 completes being active it activates motor M2. It also sets the next Op. St. equal to 2 and exits to Idle State.

(Form 10 is now in the nip of accumulator folder assembly 140, and while this was occurring printer 5 has printed the three-third page under control of data processing system 1.)

8) (S2 Op. St. 1) When sensor S2 senses the three-thirds sheet it activates sensor S3. After one page (the three-thirds sheet has passed the next Op. St. is set equal to 1 and the routine exits to the Idle State.

9) (S3, Op. St. 2) Sensor S3 activates sensor S4 and starts motor M3 when it senses the printed sheet. When the printed sheet has passed it also again calls the CHK EX PGS routine as described above. After one page (the printed sheet) has passed the next Op. St. is set equal to 1 and the routine exits to the Idle State.

10) (S4 Op. St. 2) When sensor S4 senses the printed sheet it activates motor M3 to assure that it is running and when the sheet has passed it activates motor M1. After one page has passed the next Op. St. is set equal to 1 and the routine exits to Idle State.

11) (M1, Op. St. 1, Op. St. 2) After executing Motor Pause the motor will EXECUTE NEXT to the Starting State of Op. St. 2. When the motor starts it will activate sensor S6 and gate G2 and G3.

(Gate. G3 is activated to allow the three-third to two-thirds "C" fold in the printed sheet.)

(Gate G2 is activated to allow the printed sheet to be diverted into buckle chute 112 for folding.)

12) (S6, Op. St. 2) Sensor S6 starts motor M4 and activates sensor S7 when it senses the printed sheet. When one page has passed sensor S6 will deactivate gate G2. After one page has passed sensor S6 will set the next Op. St. equal to 1 and exit to the Idle. State.

13) (S1, Op. St. 2) sensor S7 stops motor M1, activates gate G5, starts motor M7 (to feed from tray T4) and executes PCE PRE ACK when the printed sheet has passed. It also than sets the next Op. St. equal to 1 and exits to the Idle State. At this point form 10 and the three-thirds sheet, folded to two-thirds, are at the nip of the accumulator folder assembly 140 and have been aligned by gate G5, the registration gate. Also at this point, the next mail piece is started while the current mail piece continues. Those skilled in the art will readily recognize that the state routines may be executed by controller 6-1 concurrently thus allowing simultaneously processing of two mail pieces It should also be noted, that, as discussed above, the number of printed pages may vary from mail piece to mail piece within a given mail run. If the following mail piece has a different number of printed pages the page count for Pages Passed for S3, Op. St. 2 and S4, Op. St. 2 will change in accordance with the piece information transmitted from data processing system 1 for the following mail piece.

14) (G5, Op. St. 2) Gate G5 starts motor M2 to jag the printed sheet into the nip of the assembly 140 when the gate reaches Deactivating State. It also sets the next Op. St. equal to 3 and exits to Idle State.

15) (M7, Op. St. 1) Motor M7 feeds the one-third insert or BRE from tray T4. It activates sensors S13 and motor M4 when it is in the Starting State. When done running the next Op. St. is set equal to 1 and the routine exits to the Idle State.

16) (S13, Op. St. 1) Sensor S13 sets motor M7 to Stopping State activates Gate G4 to divert the one third insert to the nip of assembly 140, and activates sensor S8, all when the one-third insert is sensed. After one page is passed (the one-third insert) the Op St. is set equal to 2 and the routine exits to the Idle State.

17) (S8, Op. ST. 1) Sensor S8 will activate sensor S9 when it senses the one-third insert and activate motor M6 when it detects one page passed. Also the next Op. St. is set equal to 2 and the routine exits to the Idle State.

18) (M6, Op. St. 1) motor M6 activates motor M4 and sensor S13 when it is started. After motor M6 is done running it sets the next Op. St. equal 1 and exits to the Idle State.

19) (S13, Op. St. 2) Sensor S13 will set motor M6 to the Stopping State when it senses the two-thirds insert and activates gate G4 (to divert the two-thirds insert to apparatus 140), and enables sensor S8 at that time. When it detects one page passed it will set the Op. State equal 1 and exit to Idle. State.

20) (S8, Op. St. 2) Sensor S8 will activate sensor S9 when it senses the two-thirds insert and activate gate G5 to register the inserts when it detects one page pass (the two-thirds insert). When one page has passed the next Op. St. is set equal to 1 and the routine exits to the Idle State. When gate G5 enters the Deactivating State it will activate motor M2 to fold the accumulated sheets and form 10. When it is done gate G5 sets the next Op. St. equal to 1 and exits to the Idle State.

21) (M2, Op. St. 3) Motor M2 will activate sensor S10 and start motor M5 to activate trailing flap folder sealer 180 when it is starting. When it is done running motor M2 sets the next Op. St. equal to 1 and exits to Idle State.

22) (S10 Op. St. 1) Sensor S10 will activate sensor S11 and activate gate G6 (to moisten trailing flap 12) and set motor M4 to Stopping State when it senses the mail piece exiting from accumulator folder assembly 140. When it senses one page passed (the mail piece) it will also set motor M2 to the Stopping State, and than set Op. St. equal to 1 and exit to the Idle State.

23) (S11, Op. St. 1) Sensor S11 will activate sensor S12 and disable sensor S9 and gate G4 when it senses the mail piece. After the mail piece has passed the next Op. St. is set equal to 1 and the routine exits Idle State. (Note that the Disabled control parameter forces the control device to reset to initial conditions and return to Idle State. For a motor this is equivalent to activating the motor with the Initial State equal to Stopping.)

24) (S12 Op. St. 1) Sensor S12 causes COMPLETE to execute and sets motor M5 to Stopping State when it senses that the mail piece has passed. Then it also sets the Op. St. equal to 1 and exits to the Idle State. The completed mail piece has now been folded and sealed and output from the system.

The illustrative data structure for the above described mail piece is set forth below. Note that the above steps correspond to data elements, i.e. operations, where control parameters are set for the control of other devices. Also note that sensors S8 and S9 perform the same function, sensor S8 when a two-thirds pre-printed sheet is included in the configuration sensor S9 when only a one-thirds pre-printed sheet or BRE is included. Therefore in the above example, which includes a two-thirds sheet, sensor S9 has no role, though it is included in the data structure and activated as an artifact of the programming.

ILLUSTRATIVE DATA STRUCTURE

| | | | | | | | |
|---|---|---|---|---|---|---|---|
| Device | Sensor 1 | Sensor 2 | Sensor 3 | Sensor 3 | Sensor 4 | Sensor 4 | Sensor 6 |
| Default Init. St. | Waiting | Waiting | Waiting | Waiting | Waiting | Waiting | Waiting |
| Op. Ind. Val. | 1 (Step 1) | 1 (Step 8) | 1 (Step 2) | 2 (Step 9) | 1 (Step 3) | 2 (Step 15) | 1 (Step 5) |
| Other Devices | | | | | | | |
| Cont. Dev. | Sensor 3 | Sensor 3 | Sensor 4 | Sensor 4 | Motor 1 | Motor 1 | Sensor 7 |
| Act. Cond. | Paper Sensed | Paper Sensed | Paper Sensed | Paper Sensed | Pages Passed | Pages Passed | Paper Sensed |
| Init St. | Default | Default | Default | Default | Default | Default | Default |
| Cont. Dev. | | | Motor 3 | Motor 3 | Motor 3 | Motor 3 | Motor 4 |
| Act. Cond. | | | Paper Sensed | Paper Sensed | Paper Sensed | Paper Sensed | Paper Sensed |
| Init. St. | | | Default | Default | Default | Default | Default |
| Cont. Dev. | | | CHK EX. PGS | CHK EX PGS | PCE PRE ACK | | Gate 2 |
| Act. Cond. | | | Pages Passed | Pages Passed | Pages Passed | | Pages Passed |
| Init. St. | | | | | | | Deactivating |
| Cont. Dev. | | | | | Sensor 2 | | |
| Act. Cond. | | | | | Pages Passed | | |
| Init St. | | | | | Default | | |
| Next Op. Ind. | 1 | 1 | 2 | 1 | 2 | 1 | 2 |
| Act. Cond. | 1 pg. | 1 pg. | 1 pg. | 1 pg. | 1 pg. | 1 pg. | 1 pg. |
| Ex. NEXT | No. | No. | No. | No. | No. | No. | No. |

| | | | | | | | | |
|---|---|---|---|---|---|---|---|---|
| Device | Sensor 6 | Sensor 7 | Sensor 7 | Sensor 8 | Sensor 8 | Sensor 9 | Sensor 10 | Sensor 11 |
| Default Init. St. | Waiting | Waiting | Waiting | Waiting | Waiting | Waiting | Waiting | Waiting |
| Op. Ind. Val. | 2 (Step 12) | 1 (Step 6) | 2 (Step 13) | 1 (Step 17) | 2 (Step 20) | 1 | 1 (Step 22) | 1 (Step 23) |
| Other Devices | | | | | | | | |
| Cont. Dev. | Sensor 7 | Motor 1 | Motor 1 | Sensor 9 | Sensor 9 | | Sensor 11 | Sensor 12 |
| Act. Cond. | Paper Sensed | Pages Sensed | Pages Passed | Paper Sensed | Paper Sensed | | Paper Sensed | Paper Sensed |
| Init St. | Default | Stopping | Stopping | Default | Default | | Default | Default |
| Cont. Dev. | Motor 4 | Gate 5 | Gate 5 | Motor 6 | Gate 5 | | Gate 6 | Sensor 9 |
| Act. Cond. | Paper Sensed | Pages Passed | Pages Passed | Pages Passed | Pages passed | | Paper Sensed | Paper Sensed |
| Init. St. | Default | Default | Default | Default | Default | | Default | Disabled |
| Cont. Dev. | Gate 2 | | Motor 7 | | | | Motor 4 | Gate 4 |
| Act. Cond. | Pages Passed | | Pages Passed | | | | Paper Sensed | Paper Sensed |
| Init. St. | Deactivating | | Default | | | | Stopping | Disabled |
| Cont. Dev. | | | PCE PRE ACK | | | | | |
| Act. Cond. | | | Pages Passed | | | | | |
| Init. St. | | | | | | | | |
| Next Op. Ind. | 1 | 2 | 1 | 2 | 1 | 1 | 1 | 1 |
| Act. Cond. | 1 pg. | 1 pg. | 1 pg. | 1 pg. | 1 pg. | 1 pg. | 1 pg. | 1 pg. |
| EX. NEXT | No. | No. | No. | No. | No. | No. | No. | No. |

| | | | | | | | |
|---|---|---|---|---|---|---|---|
| Device | Sensor 12 | Sensor 13 | Sensor 13 | Motor 1 | Motor 1 | Motor 2 | Motor 2 |
| Default Init. St. | Waiting | Waiting | Waiting | Motor Pause | Starting | Starting | Starting |
| Op. Ind. V 1. | 1 (Step 24) | 1 (Step 16) | 2 (Step 19) | 1 (Steps 4, 11) | 2 (Steps 4, 11) | 1 | 2 |
| Other Devices | | | | | | | |

-continued

ILLUSTRATIVE DATA STRUCTURE

| | | | | | | | |
|---|---|---|---|---|---|---|---|
| - Cont. Dev. | PCE COMP | Motor 7 | Motor 6 | | Sensor 6 | | |
| - Act. Cond. | Pages Passed | Paper Sensed | Paper Sensed | | Starting | | |
| - Init St. | Default | Stopping | Stopping | | Default | | |
| - Cont. Dev. | Motor 5 | Gate 4 | Gate 4 | | Gate 3 | | |
| - Act. Cond. | Pages Passed | Paper Sensed | Paper Sensed | | Starting | | |
| - Init. St. | Stopping | Default | Deactivating | | Default | | |
| - cont. Dev. | | Sensor 8 | Sensor 8 | | Gate 2 | | |
| - Act. Cond. | | Paper Sensed | Paper Sensed | | Starting | | |
| - Init. St. | | Default | Default | | Default | | |
| - Cont. Dev. | | | | | | | |
| - Act. Cond. | | | | | | | |
| - Init St. | | | | | | | |
| Next Op. Ind. | 1 | 2 | 1 | 2 | 1 | 2 | 3 |
| - Act. Cond. | 1 pg. | 1 pg. | 1 pg. | Done Running | Done Running | Done Running | Done Running |
| - Ex. NEXT | No. | No. | No. | Yes | No | No | No. |

| | | | | | | | |
|---|---|---|---|---|---|---|---|
| Device | Motor 2 | Motor 3 | Motor 4 | Motor 5 | Motor 6 | Motor 7 | Gate 1 |
| Default Init. St. | Starting | Starting | Starting | Starting | Starting | Starting | Activating |
| Op. Ind. Val. | 3 (Step 21) | 1 | 1 | 1 | 1 (Step 18) | 1 (Step 15) | 1 |
| Other Devices | | | | | | | |
| Cont. Dev. | Sensor 10 | | | | Motor 4 | Motor 4 | |
| Act. Cond. | Starting | | | | Starting | Starting | |
| Init. St. | Default | | | | Default | Default | |
| Cont. Dev. | Motor 5 | | | | Sensor 13 | Sensor 13 | |
| Act. Cond. | Starting | | | | Starting | Starting | |
| Init. St. | Default | | | | Default | Default | |
| Cont. Dev. | | | | | | | |
| Act. Cond. | | | | | | | |
| Init. St. | | | | | | | |
| Cont. Dev. | | | | | | | |
| Act. Cond. | | | | | | | |
| Init St. | | | | | | | |
| Next Op. Ind. | 1 | 1 | 1 | 1 | 1 | 1 | 1 |
| Act. Cond. | Done Running | Done Running | Done Running | Done Running | Done Running | Done Running | Done Active |
| Ex. NEXT | No | No | No | No | No | No | No |

| | | | | | |
|---|---|---|---|---|---|
| Device | Gate 2 | Gate 2 | Gate 3 | Gate 4 | Gate 4 |
| Default Init. St. | Deactivated | Activating | Deactivated | Activating | Activating |
| Op. Ind. Val. | 1 | 2 | 1 | 1 | 2 |
| Other Devices | | | | | |
| Cont. Dev. | | | | | |
| Act. Cond. | | | | | |
| Init. St. | | | | | |
| Cont. Dev. | | | | | |
| Act. Cond. | | | | | |
| Init St. | | | | | |
| Cont. Dev. | | | | | |
| Act. Cond. | | | | | |
| Init. St. | | | | | |
| Cont. Dev. | | | | | |
| Act. Cond. | | | | | |
| Init. St. | | | | | |
| Next Op. Ind. | 2 | 1 | 1 | 2 | 1 |
| Act. Cond. | Done Not Act. | Done Active | Done Not Act. | Done Active | Done Active |
| Ex. NEXT | Yes | No | No | Yes | No |

| | | | | |
|---|---|---|---|---|
| Device | Gate 5 | Gate 5 | Gate 5 | Gate 6 |
| Default Init. St. | Activating | Activating | Activating | Activating |
| Op. Ind. Val | 1 (Step 7) | 2 (Step 14) | 3 (Step 24) | 1 |
| Other Devices | | | | |
| Cont. Dev. | Motor 2 | Motor 2 | Motor 2 | |
| Act. Cond. | Deactivating | Deactivating | Deactivating | |
| Init. St. | Jogging | Jogging | Default | |
| Cont. Dev. | | | | |
| Act. Cond. | | | | |
| Init. St. | | | | |
| Cont. Dev. | | | | |
| Act. Cond. | | | | |
| Init. St. | | | | |
| Cont. Dev. | | | | |
| Act. Cond. | | | | |
| Init. St. | | | | |
| Next Op. Ind. | 2 | 3 | 1 | 1 |
| Act. Cond. | Done Active | Done Active | Done Active | Done Active |
| Ex. NEXT | No | No | No | No |

The above descriptions, examples and drawings have been provided by way of illustration only and those skilled int he are will recognize numerous other embodiments of the subject invention form the information provided. Accordingly limitations on the scope of the subject invention are to be found only in the claims set forth below.

What is claimed is:

1. A control system for controlling a process for producing an item, said process comprising operations selected from a plurality of operations, said control system comprising:

a) input means for input of information defining a particular output configuration;

b) translating means for translating said defining information into a data structure defining a sequence of said operations for producing an item having said particular output configurations;

c) control means responsive to said data structure for controlling said process to perform said sequence of said operations on input materials; whereby said input materials are processed to produce said item having said particular output configuration;

d) wherein said control means comprises a data processor, said operations comprise sequences of states, and said control means controls said process by executing sequences of state routines in accordance with said data structure, execution of said state routines in accordance with said data structure effecting performance of said states;

e) wherein further, said data structure comprises a plurality of data elements, each of said data elements specifying control parameters for one of said operations;

f) wherein further, said process is carried out by an apparatus comprising a plurality of devices, said devices operating under control of said state routines to effect said states.

g) wherein further, said data elements are each associated with a particular one of said devices;

h) wherein further, a plurality of said data elements is associated with one of said particular devices; and, i) wherein each of said plurality of data elements associated with said one particular device is identified by an operation index value, and state routines associated with said one particular device execute in accordance with one of said plurality of data elements having an operation index value equal to a current index value, the initial value of said current index value being predetermined, and wherein said plurality of data elements associated with said one particular device each specify a next value for said current index value; whereby said one particular device may perform a sequence of operations in accordance with different control parameters.

2. A control system as described in claim 1 wherein at least one of said operations may be varied in accordance with a variable parameter defined in said data structure, said control means is responsive to an initial signal to respond to said data structure to produce said item, and said initial signal includes a specific parameter value signal, and said control means is responsive to said specific parameter value signal to modify said variable parameter, whereby said item produced in response to said initial signals will vary, within said configuration, in accordance with said specific parameter value signal.

3. A control system as described in claim 1 wherein, during execution, at least one of said state routines selects, in accordance with said data structure, another of said state routines for later execution.

4. A control system as described in claim 1 wherein said data elements specify devices which are to be enabled or disabled during execution of an associated state routine, whereby said data elements specify successive sequences of operations and said data structure specifies said configuration.

5. A control system as described in claim 1 wherein each of said devices corresponds one-to-one to one of a plurality of idle state routines, and said control means executes said idle state routines in sequence to identify which of said devices have been enabled to effect said operations.

6. A control system as described in claim 5 wherein said control means responds to identification of an enabled device by executing an initial state routine specified by one of said data elements associated with said enabled device.

7. A control system for controlling a process for producing an item, said process comprising operations selected from a plurality of operations, said control system comprising:

a) input means for input of information defining a particular output configuration;

b) translating means for translating said defining information into a data structure defining a sequence of said operations for producing an item having said particular output configurations;

c) control means responsive to said data structure for controlling said process to perform said sequence of said operations on input materials; whereby said input materials are processed to produce said item having said particular output configuration;

d) wherein said control means comprises a data processor, said operations comprise sequences of states, and said control means controls said process by executing sequences of state routines in accordance with said data structure, executing of said state routines in accordance with said data structure effecting performance of said states;

e) wherein further, said data structure comprises a plurality of data elements, each of said data elements specifying control parameters for one of said operations;

f) wherein further, said process is carried out by an apparatus comprising a plurality of devices, said devices operating under control of said state routines to effect said states;

g) wherein further, each of said devices corresponds one-to-one to one of a plurality of idle state routines, and said control means executes said idle state routines in sequence to identify which of said devices have been enabled to effect said operations; and, h) wherein said control means responds to identification of an enabled device by executing an initial state routine specified by one of said data elements associated with another of said devices.

8. A control system as described in claims 2, 3, 6, 4, 5, 1, or 7 wherein said item is a mail piece.

9. A control system as described in claim 8 wherein said item comprises at least one sheet accumulated with an envelope form, and wherein said accumulated sheet and envelope form are folded and sealed to form said mail piece.

10. A control apparatus for controlling a process, said process comprising operations selected from a plurality of operations, said apparatus comprising;

a) input means for input of a data structure, said data structure defining an output configuration;

b) data processing means, responsive to said data structure for controlling said process in accordance with said data structure to perform a sequence of said operations on input materials, said sequence of said operations being selected in accordance with said data structure so that said input materials are processed to produce an item having said output configuration;

c) wherein at least one of said operations may be varied in accordance with a variable parameter defined in said data structure, said data processing means is responsive to an initial signal to respond to said data structure to produce said item, and said initial signal includes a specific parameter value signals, and said data processing means is responsive to said specific parameter value signal to modify said variable parameter, whereby said item produced in response to said initial signals will vary, within said configuration, in accordance with said specific parameter value signal;

d) wherein further, said operations comprise sequences of states, and said data processing means controls said process by executing sequences of state routines in accordance with said data structure, execution of said state routines in accordance with said data structure effecting said states;

e) wherein further, said data structure comprises a plurality of data elements, each of said data elements specifying control parameters for one of said operation;

f) wherein further, said process is carried out by an apparatus comprising a plurality of devices, said devices operating under control of said state routines to effect said states;

g) wherein further, said data elements are each associated with a particular one of said devices;

h) wherein further, a plurality of said data elements is associated with one of said particular devices; and, i) wherein each of said plurality of data elements associated with a one particular devices is identified by an operation index value, and state routines controlling said one particular one of said device execute in accordance with one of said plurality of data elements having an operation index value equal to a current index value, the initial value of said current index value being predetermined, and wherein said plurality of data elements associated with a one particular device each specify a next value for said current index value; whereby said one particular of said device may perform a sequence of operations in accordance with different, control parameters.

11. A control system as described in claim 10 wherein, during execution, at least one of said state routines selects, in accordance with said data structure, another of said state routines for later execution.

12. A control apparatus as described in claim 10 wherein said data elements specify devices which are to be enabled or disabled during execution of an associated state routine, whereby said data elements specify successive sequences of operations and said data structure specifies said configuration.

13. A control system as described in claim 10 wherein each of said devices corresponds one-to-one, to one of a plurality of idle state routines, and said control means executes said idle state routines in sequence to identify which of said devices have been enabled to effect said operations.

14. A control apparatus as described in claim 13 wherein said data processing means responds to identification of an enabled device by executing an initial state routines specified by one of said data elements associated with said enabled device.

15. A control apparatus for controlling a process, said process comprising operations selected from a plurality of operations, aid apparatus comprising:

a) input means for input of a data structure; said data structure defining an output configuration.

b) data processing means, responsive to said data structure for controlling said process in accordance with said data structure to perform a sequence of said operations on input materials, said sequence of said operations being selected in accordance with said data structure so that said input materials are processed to produce an item having said output configuration;

c) wherein, at least one of said operations may be varied in accordance with a variable parameter defined in said data structure, said data processing means is responsive to an initial signal to respond to said data structure to produce said item, and said initial signal includes a specific parameter value signal, and said data processing means is responsive to said specific parameter value signal to modify said variable parameter, whereby said item produced in response to said initial signal swill vary, within said configuration, in accordance with said specific parameter value signal;

d) wherein further, said operations comprise sequences of states, and said data processing means controls said process by executing sequences of state routines in accordance with said data structure, execution of said state routines in accordance with said data structure effecting said states;

e) wherein further, said data structure comprises a plurality of data elements, each of said data elements specifying control parameters for one of said operations.

f) wherein further, said process is carried out by an apparatus comprising a plurality of devices, said devices operating under control of said state routines to effect said states;

g) wherein further, each of said devices corresponds one-to-one to one of a plurality of idle state routines in sequence to identify which of said devices have been enabled to effect said operations; and, h) wherein said data processing means responds to identification of an enabled device by executing an initial state routine specified by one of said data elements associated with another of said devices.

16. A control apparatus as described in claims 11, 14, 13, 10, or 15 wherein said item is a mailpiece.

17. A control system as described in claim 16 wherein said item comprises at least one sheet accumulated with an envelope form, and wherein said accumulated sheet and envelope form are folded and sealed to form said mail piece.

18. A method for controlling a process, said process comprising operations selected from a plurality of operations, said method comprising the steps of:

a) inputting information defining an output configuration;

b) translating said defining information into a data structure specifying a sequence of operations for producing items having said output configuration;

c) controlling said process in accordance with said data structure to perform said sequence of operations on input materials, whereby said input materials are processed to produce an item having said output configuration;

d) wherein said operations comprise sequences of states, and said controlling step of controlling said process by executing sequences of state routines in accordance with said data structure, execution of said state routines in accordance with said data structure effecting said states;

e) wherein further, said data structure comprises a plurality of data elements, each of said data elements specifying control parameters for one of said operations;

f) wherein further, during execution, at least one of said state routines selects, in accordance with said data structure, another of said state routines for later execution;

g) wherein further, said process is carried out by an apparatus comprising a plurality of devices, said devices operating under control of said state routines to effect said states;

h) wherein further, said data elements are each associated with a particular one of said devices;

i) wherein further, a plurality of said data elements is associated with one of said particular devices; and, j) wherein each of said plurality of data elements associated with said one particular device is identified by an operation index value, and state routines associated with said one particular device execute in accordance with one of said plurality of data elements having operation index value equal to a current index value, the initial value of said current index value being predetermined, and wherein said plurality of data elements associated with said one particular device each specify a next value for said current index value; whereby said particular one of said devices may perform a sequence of operations in accordance with different control parameters.

19. A method as described in claim 18 wherein at least one of said operations may be varied in accordance with a parameter defined in said data structure, said process includes a step of providing an initial signal to initiate said process, and said initial signal include a specific parameter value signal, and said controlling step includes the step of responding to said specific parameter value signal to modify said parameter, whereby said item produced in response to said initial signals will vary, within said configuration, in accordance with said specific parameter value signals.

20. A method as described in claim 18 wherein, during execution, at least one of sad state routines selects, in accordance with said data structure, another of said state routines for later execution.

21. A method as described in claim 18 wherein said data elements specify devices which are to be enabled or disabled during execution of an associated state routine, whereby said data elements specify successive sequences of operations and said data structure specifies said configurations.

22. A control system as described in claim 18 wherein each of said devices corresponds one-to-one to one of a plurality of idle state routines, and said control means executes said idle state routines in sequence to identify which of said devices have been enabled to effect said operations.

23. A method as described in claim 22 wherein said controlling step includes the step of responding to identification of an enabled device to execute an initial state routine specified by one of said data elements associated with said enabled device.

24. A method for controlling a process, said process comprising operations selected from a plurality of operations, said method comprising the steps of:

a) inputting information defining an output configuration;

b) translating said defining information into a data structure specifying a sequence of operations for producing items having said output configuration;

c) controlling said process in accordance with said data structure to perform said sequence of operations on input materials, whereby said input materials are processed to produce an item having said output configuration;

d) wherein said operations comprise sequences of states, and said controlling step includes the step of controlling said process by executing sequences of state routines in accordance with said data structure, execution of said state routines in accordance with said data structure effecting said states;

e) wherein further, said data structure comprises a plurality of data elements, each of said data elements specifying control parameters for one of said operations;

f) wherein further, during execution, at least one of said state routines selects, in accordance with said data structure, another of said state routines for later execution;

g) wherein further said process is carried out by an apparatus comprising a plurality of devices, said devices operating under control of said state routines to effect said states;

h) wherein further each of said devices corresponds to an idle state routine comprised in a corresponding plurality of idle state routines, and said control means executes said idle sate routines in sequence to identify which of said devices have been enabled to effect said operations;

i) wherein further, said controlling step includes the step of responding to identification of an enabled device to execute an initial state routine specified by one of said data elements associated with said enabled device; and, j) wherein said controlling step includes the step of responding to identification of an enabled device to execute an initial state routine specified by one of said data elements associated with another of said devices.

25. A method as described in claims 19, 20, 23, 21, 22, 18 or 24, wherein said item is a mail piece.

26. A method as described in claim 25 wherein said process comprises the steps of accumulating at least one sheet with an envelope form and folding and sealing said accumulated sheet and envelope form to form said mail piece.

* * * * *